US008549870B2

(12) United States Patent
Lee et al.

(10) Patent No.: US 8,549,870 B2
(45) Date of Patent: Oct. 8, 2013

(54) WATER CIRCULATION SYSTEM ASSOCIATED WITH REFRIGERANT CYCLE

(75) Inventors: Sung Su Lee, Changwon (KR); Jong Chul Ha, Changwon (KR)

(73) Assignee: LG Electronics Inc., Seoul (KR)

( * ) Notice: Subject to any disclaimer, the term of this patent is extended or adjusted under 35 U.S.C. 154(b) by 735 days.

(21) Appl. No.: 12/729,517

(22) Filed: Mar. 23, 2010

(65) Prior Publication Data

US 2011/0154844 A1 Jun. 30, 2011

(30) Foreign Application Priority Data

Dec. 31, 2009 (KR) ..... 10-2009-0136005

(51) Int. Cl.
*F25B 7/00* (2006.01)

(52) U.S. Cl.
USPC ..... 62/335

(58) Field of Classification Search
USPC ..... 62/278, 335, 510
See application file for complete search history.

(56) References Cited

U.S. PATENT DOCUMENTS

2008/0190130 A1* 8/2008 Murakami et al. ..... 62/324.3
2010/0282435 A1* 11/2010 Yabuuchi et al. ..... 165/63

FOREIGN PATENT DOCUMENTS

CN 2 570 706 Y 9/2003
EP 2 363 664 A1 9/2011
JP H04-103571 U 9/1992
WO WO 2011/045751 A1 4/2011

OTHER PUBLICATIONS

European Search Report dated Nov. 26, 2012 issued in Application No. 10 25 0798.

* cited by examiner

*Primary Examiner* — Melvin Jones
(74) *Attorney, Agent, or Firm* — KED & Associates LLP

(57) ABSTRACT

The present invention proposes a water circulation system associated with a refrigerant cycle that can selectively heat-exchange water for cooling and heating and hot water supplying with at least one of a first refrigerant and a second refrigerant. Therefore, the present invention can improve the operation efficiency of the water circulation system associated with the refrigerant cycle.

20 Claims, 18 Drawing Sheets

WATER CIRCULATION SYSTEM ASSOCIATED WITH REFRIGERANT CYCLE

BACKGROUND OF THE INVENTION

1. Field of the Invention

The present invention relates to an indoor unit of a water circulation system performing a hot water supplying function and cooling and heating functions in association with a refrigerant cycle.

2. Description of the Related Art

In the related art, indoor cooling and heating are performed by an air conditioner using the refrigerant cycle and supplying hot water is performed by a boiler with an additional heating source.

More specifically, the air conditioner includes an outdoor unit installed in an outdoor area and an indoor unit installed in an indoor area. The outdoor unit includes a compressor compressing refrigerant, an outdoor heat exchanger for exchanging heat of outdoor air with the refrigerant, and a decompressing device and the indoor unit includes an indoor heat exchanger for exchanging heat of indoor air with the refrigerant. At this time, any one of the outdoor heat exchanger and the indoor heat exchanger serves as a condenser and the other one serves as an evaporator and the compressor, the outdoor heat exchanger, the decompressing device, and the indoor heat exchanger perform a refrigerant cycle.

In addition, the boiler generates heat by using oil, gas, or electricity and heats water to supply hot water or perform floor heating.

SUMMARY OF THE INVENTION

The present invention provides a water circulation system associated with a refrigerant cycle that can selectively heat exchange water for cooling and heating and hot water supplying with at least one of a first refrigerant and a second refrigerant. The water circulation system associated with the a refrigerant cycle according to the present invention includes: a first refrigerant circulation unit where a first refrigerant exchanging heat with outdoor air flows to perform the refrigerant cycle; a second refrigerant circulation unit where a second refrigerant exchanging heat with the first refrigerant flows to perform the refrigerant cycle; a water circulation unit where water for at least one of indoor heating/cooling and hot water supplying flows; a first water heat exchanger where the heat exchange between the first refrigerant and water is performed; a second water heat exchanger where the heat exchange between the second refrigerant and water is performed; a first flow control unit that selectively prevents the flow of water to the first water refrigerant heat exchanger; and a second flow control unit that selectively prevents the flow of water to the second water refrigerant heat exchanger. Therefore, the present invention can improve the operation efficiency of the water circulation system associated with the refrigerant cycle.

DETAILED DESCRIPTION OF THE EMBODIMENTS

Reference will now be made in detail to the embodiments of the present disclosure, examples of which are illustrated in the accompanying drawings.

In the following detailed description of the preferred embodiments, reference is made to the accompanying drawings that form a part hereof, and in which is shown by way of illustration specific preferred embodiments in which the invention may be practiced. These embodiments are described in sufficient detail to enable those skilled in the art to practice the invention, and it is understood that other embodiments may be utilized and that logical structural, mechanical, electrical, and chemical changes may be made without departing from the spirit or scope of the invention. To avoid detail not necessary to enable those skilled in the art to practice the invention, the description may omit certain information known to those skilled in the art. The following detailed description is, therefore, not to be taken in a limiting sense, and the scope of the present invention is defined only by the appended claims.

Figure 1:
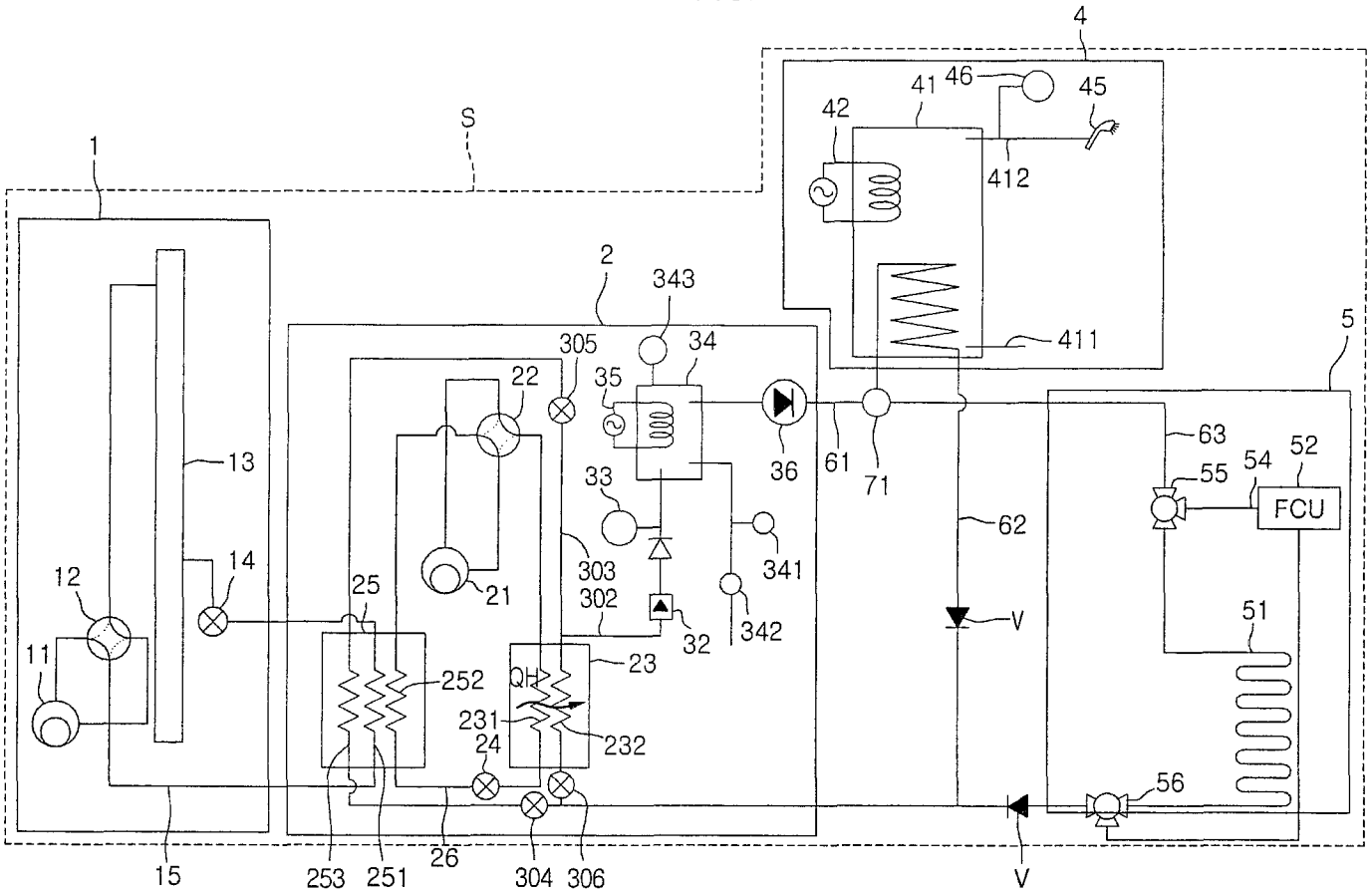
FIG. 1 is a configuration diagram of a first embodiment of a water circulation system associated with a refrigerant cycle according to the present invention.

FIG. 1 is a configuration diagram of a first embodiment of a water circulation system associated with a refrigerant cycle according to the present invention.

Referring to FIG. 1, the water circulation system S associated with the refrigerant cycle includes a first refrigerant circulation unit where first refrigerant exchanging heat with outdoor air flows to perform the refrigerant cycle, a second refrigerant circulation unit where second refrigerant exchanging heat with the first refrigerant flows to perform the refrigerant cycle, and a water circulation unit where water for at least one of indoor heating/cooling and hot water supplying. At this time, the refrigerant cycle means transmitting the heat by repetitively performing compression, condensation, expansion, and evaporation processes.

In addition, the water circulation system S associated with the refrigerant cycle includes an outdoor unit 1 where an outdoor heat exchanger 13 exchanging the first refrigerant and the outdoor air with each other is installed and an intermediator 2 that intermediates the outdoor 1 with the water circulation unit and includes a water refrigerant heat exchanger 23 exchanging heat between the second refrigerant and water.

Specifically, the first refrigerant circulation unit includes the outdoor heat exchanger 13, a first compressor 11 compressing the first refrigerant, a first expansion unit 14 expanding the first refrigerant, a first flow switch 12 switching a flow direction of the first refrigerant, an intermediate heat exchanger 25 exchanging heat between the first refrigerant and the second refrigerant, and a first refrigerant pipe 15. That is, the first refrigerant performs the refrigerant cycle while sequentially circulating any one of the first compressor 11, the outdoor heat exchanger 13, and the intermediate heat exchanger 25 and the other one of the first expansion unit 14, the outdoor heat exchanger 13, and the intermediate heat exchanger. Further, by the first flow switch 12, the flow direction of the first refrigerant may be switched into a direction in which the first refrigerant is introduced into the outdoor heat exchanger 13 from the intermediate heat exchanger 25 through the first expansion unit 14 or a reverse direction.

In addition, the second refrigerant circulation unit includes the intermediate heat exchanger 25, a second compressor 21 compressing the second refrigerant, a second expansion unit 24 expanding the second refrigerant, a second flow switch 22 switching a flow direction of the second refrigerant, the water refrigerant heat exchanger 23, and a second refrigerant pipe 26. That is, the second refrigerant performs the refrigerant cycle while sequentially circulating any one of the second compressor 21, the intermediate heat exchanger 25, and the water refrigerant heat exchanger 23 and the other one of the second expansion unit 24, the intermediate heat exchanger 25, and the water refrigerant heat exchanger 23. Further, by the second flow switch 22, the flow direction of the second refrigerant may be switched into a direction in which the second refrigerant is introduced into the intermediate heat exchanger 25 from the water refrigerant heat exchanger 23 through the second expansion unit 24 or a reverse direction.

At this time, the intermediate heat exchanger 25 through which the first referent, second refrigerant, and water pass at the same time is included in the first refrigerant circulation unit or included in the second refrigerant circulation unit. In addition, in the intermediate heat exchanger 25, three flow passages 251, 252, and 253 for allowing the first refrigerant, second refrigerant, and water to flow, respectively are formed. Accordingly, in the intermediate heat exchanger 25, the first refrigerant, second refrigerant, and water exchange heat with each other at the same time. That is, the intermediate heat exchanger 25 serves as the water refrigerant heat exchanger where the heat is exchanged between the water and the water in a functional sense.

In another aspect, the intermediate heat exchanger 25 may serve as a first water refrigerant heat exchanger where the heat is exchanged between the first refrigerant and the water and the water refrigerant heat exchanger 23 may serve as a second water refrigerant heat exchanger where the heat is exchanged between the second refrigerant and the water.

Meanwhile, the outdoor heat exchanger 13, the first compressor 11, the first expansion unit 14, and the first flow switch 12 are installed in the outdoor unit 1. In the case where the outdoor unit 1 is operated in a cooling mode, the outdoor heat exchanger 13 serves as the condenser and serves as the evaporator in the case where the outdoor unit 1 is operated in a heating mode.

In addition, the intermediate heat exchanger 25, the water refrigerant heat exchanger 23, the second compressor 21, and the second flow switch 22 are installed in the intermediator 2. Moreover, in the intermediator 2, the water refrigerant heat exchanger 23, a flow switch 32 that is mounted on a water pipe 61 extending to the outlet of the water refrigerant heat exchanger 23 and senses the flow of the water, an expansion tank 33 branched from any point separated from the flow switch 32 in the flow direction of the water, a water collection tank 34 into which the end of the water pipe 61 extending from the outlet of the water refrigerant heat exchanger 23 is inserted and which an auxiliary heat 35 is provided, and a water pump 36 provided at any point of the water pipe 61 of the outlet side of the water collection tank 34.

More specifically, the water refrigerant heat exchanger 23 may adopt, for example, a plate-type heat exchanger as a device where the heat is exchanged between refrigerant that flows on a closed circuit of the refrigerant cycle and water that flows on the water pipe 61. At least two flow passages 231 and 232 where the refrigerant and the water independently flow and exchange the heat are formed in the water refrigerant heat exchanger 23.

Further, when the volume of water heated while passing through the water refrigerant heat exchanger 23 is expanded at an appropriate level or more, the expansion tank 33 performs an absorption function to absorb the expansion.

Further, the water collection tank 34 is a container where the water passing through the water refrigerant heat exchanger 23 is collected. In addition, the auxiliary heat 35 is mounted in the water collection tank 34, such that the auxiliary heat 35 is selected operated in the case where a heat quantity transferred through the water refrigerant heat exchanger 23 does not reach a required heat quality like a case where a defrosting operation is performed.

In addition, an air vent 343 is formed on the top of the water collection tank 34 to discharge air of an overheat state that exists in the water collection tank 34. Moreover, a pressure gauge 341 and a relief valve 342 are provide at one portion of the water collection tank 34, such that the internal pressure of the water collection tank 34 may appropriately be controlled. For example, when the internal water pressure of the water collection tank 34 displayed through the pressure gauge 341 is excessively high, the relief valve 342 is opened to appropriately control the internal pressure of the tank.

Further, the water pump 36 pumps water discharged through the water pip 61 extending from the outlet of the water collection tank 34 to supply it to a hot water supplying unit 4 and a cooling/heating unit 5.

Meanwhile, the water circulation unit includes the hot water supplying unit 4 where water for supplying hot water, that is, hot water supplying flows and the cooling/heating unit 5 where water for indoor cooling and heating flows.

More specifically, the hot water supplying unit 4 is a part heating and supplying water required for an operation such as user's washing or dish-washing. Specifically, a three-way valve 71 controlling the flow of the water is provided at any point separated from the water pump 36 in the flow direction of the water. The three-way valve 71 is a direction change valve that allows the water pumped by the water pump 36 to flow to the hot water supplying unit 4 or the cooling/heating unit 5. Accordingly, each of a hot water supplying pipe 62 extending to the hot water supplying unit 4 and the cooling/heating pipe 63 extending to the cooling/heating unit 5 are connected to the outlet of the three-way valve 71. In addition, the water pumped by the water pump 36 selectively flows to any one of the hot water supplying pipe 62 or the cooling/heating pipe 63 by the control of the three-way valve 71.

A hot water supplying tank 41 that stores water supplied from the outside and heats the stored water and an auxiliary heat 42 that is provided in the hot water supplying tank 41 are included in the hot water supplying unit 4. In addition, a water introduction portion 411 for introducing cooling water and a water discharge portion 412 for discharging heated water are provided on one side of the hot water supplying unit.

Specifically, a part of the hot water supplying pipe 62 extending from the three-way valve 71 is inputted into the hot water supplying tank 41 and heats the water stored in the hot water supplying tank 41. That is, heat is transmitted from high-temperature water that flows along the inside of the hot water supplying pipe 62 to the water stored in the hot water supplying tank 41. In addition, in a predetermined case, the auxiliary heat 35 and the auxiliary heat source operate to further supply additional heat. For example, like a case where the user needs a lot of water to take a bath, they may operate when the water needs to be heated within a short time. According to the embodiment, a water discharge device such as a shower or a home appliance device such as a humidifier may be connected to the water discharge unit 412.

Meanwhile, the cooling/heating unit 5 includes a floor cooling/heating unit 51 formed by burying a part of the cooling/heating pipe 63 in an indoor floor and an air cooling/heating unit 52 that is branched from any one point of the cooling/heating pipe 63 and in parallel, connected with the floor cooling/heating unit 51.

Specifically, the floor cooling/heating unit 51 may be buried in the indoor floor in the form of a meander line as shown in the figure. Further, the air cooling/heating unit 52 may be a fan coil unit or a radiator, etc. Further, in the air cooling/heating unit 52, a part of the air cooling/heating pipe 54 branched from the cooling/heating pipe 63 is provided as a heat exchange means. Moreover, a flow passage switching valve 56 such as the three-way valve 71 is installed at a point where the air cooling/heating pipe is branched and refrigerant that flows on the cooling/heating pipe 63 flows by being divided into the floor cooling/heating unit 51 and the air cooling/heating unit 52 or flows to only any one of the floor cooling/heating unit 51 and the air cooling/heating unit 52.

Further, an end portion of the hot water supplying pipe 62 extending from the three-way valve 71 is united at a point separated from an outlet of the air cooling/heating pipe 54 in the flow direction of the water. Therefore, in a hot water supplying mode, the refrigerant that flows on the hot water supplying pipe 62 is combined into the cooling/heating pipe again and thereafter, is introduced into the water refrigerant heat exchanger 23.

Herein, like a point where the hot water supplying 62 is combined with the cooling/heating pipe 63, a check valve V is installed at a point requiring backflow prevention to prevent the backflow of the water. In the same context, except for a method of installing the flow passage switching valve 56, the check valve will be able to be installed at each of the outlet of the air cooling/heating pipe 54 and the outlet of the floor cooling/heating unit 51.

Meanwhile, the water pipe 61 guides the flow of the water for performing any one of the hot water supplying and the indoor cooling/heating. The water pipe 61 includes the hot water supplying pipe 62 guiding the water discharged from the water pump 36 to the hot water supplying unit 4, the cooling/heating pipe 63 guiding the water discharged from the water pump 36 to the cooling/heating unit 5, a main pipe 302 connecting the water refrigerant heat exchanger and the water pump with each other, and a branch pipe 303 branched from the main pipe 302 in order to the water passing through any one of the hot water supplying unit 4 and the cooling/heating unit 5 to the intermediate heat exchanger 25. One end of the branch pipe 303 is connected to one corresponding point of the main pipe 302 between the point where the hot water supplying pipe 62 and the cooling/heating pipe 63 are combined and the water refrigerant heat exchanger 23 and the other end of the branch pipe 303 is connected to the other point of the main pipe 303 corresponding to a discharge side of the water refrigerant heat exchanger.

At this time, the water circulation system associated with the refrigerant cycle further includes a first flow control unit 304 selectively preventing the flow of the water to the intermediate heat exchanger 25, a second flow control unit 306 selectively preventing the flow of the water to the water refrigerant heat exchanger 23, and a third flow control unit 305 selectively preventing the flow of water discharged from the intermediate heat exchanger 25. The first flow control unit 304 is installed at one point of the branch pipe 303 corresponding to an inlet of the intermediate heat exchanger, the second flow control unit 306 is installed at one point of the main pipe 302 corresponding to a downstream side of the point where the branch pipe 303 is branched, and the third flow control unit 305 is installed at the other point of the branch pipe 303 corresponding to a discharge side of the intermediate heat exchanger 25.

The first flow control unit 304 and the second flow control unit 306 serves to control a flowing amount of the water passing through the hot water supplying unit 4 and the cooling/heating unit 5 to the intermediate heat exchanger 25 and the water refrigerant heat exchanger 23, respectively. In addition, the first flow control unit 304 and the third flow control unit 305 shields the introduction portion and the discharge portion of the intermediate heat exchanger 25, thereby isolating water adjacent to the intermediate heat exchanger 25.

Hereinafter, the flow of refrigerant in a first embodiment of a water circulation system associated with a refrigerant cycle according to the present invention will be described in detail with reference to the accompanying drawings.

Figure 2:
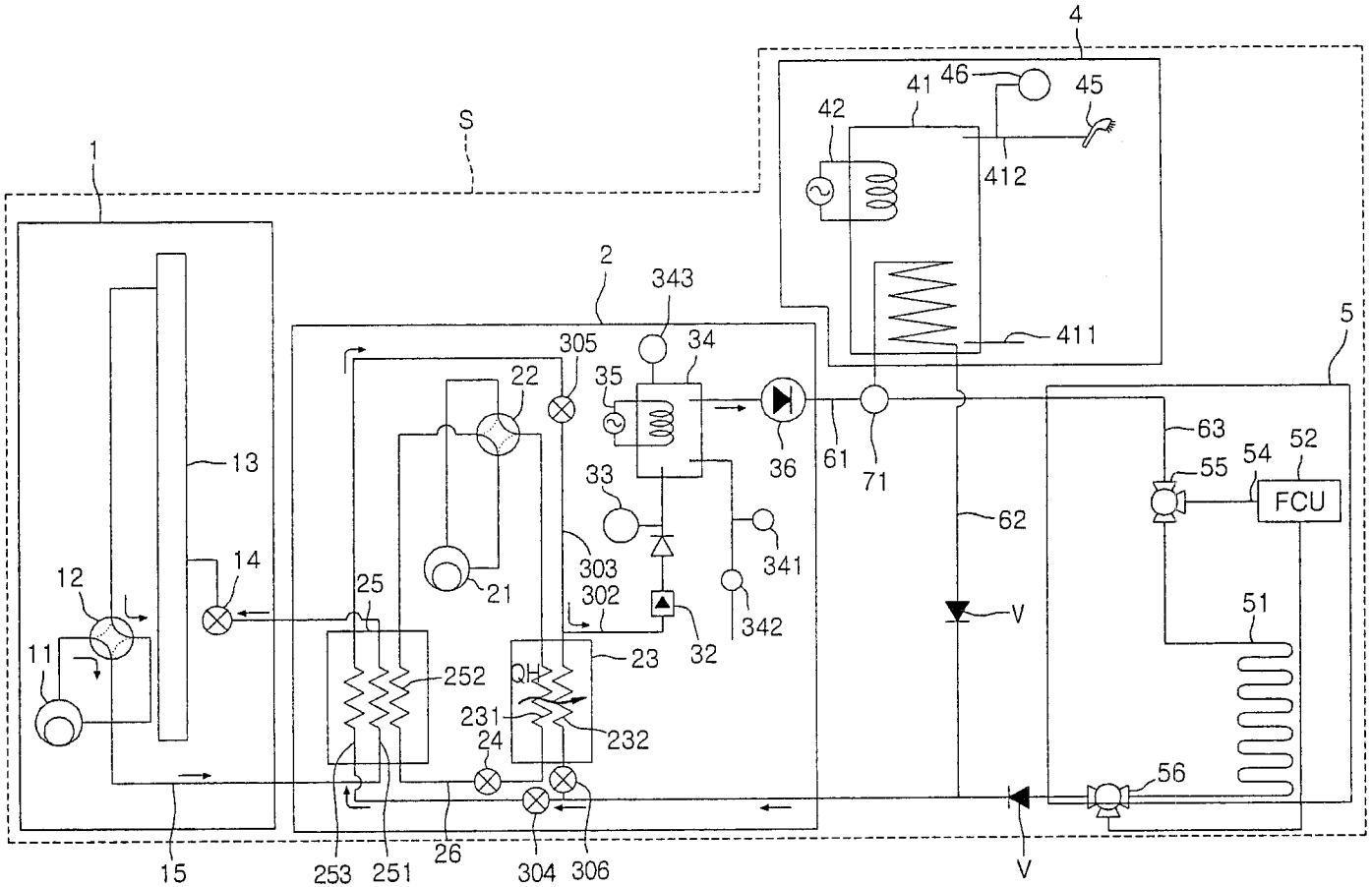
FIG. 2 is a diagram showing the flow of refrigerant when a first embodiment of a water circulation system associated with a refrigerant cycle according to the present invention is operated in one-stage compression type.
Figure 3:
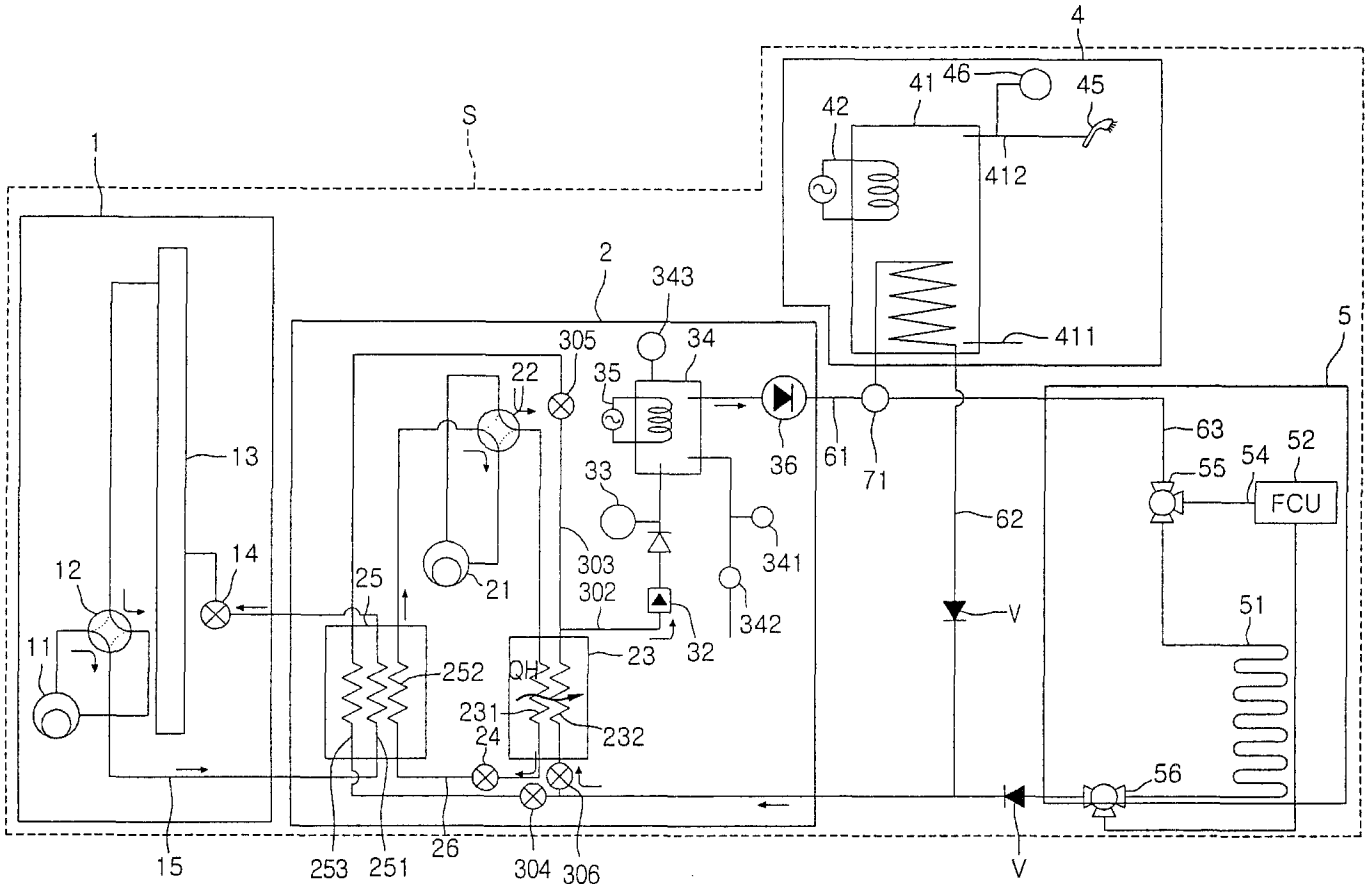
FIG. 3 is a diagram showing the flow of refrigerant when a first embodiment of a water circulation system associated with a refrigerant cycle according to the present invention is operated in two-stage compression type.
Figure 4:
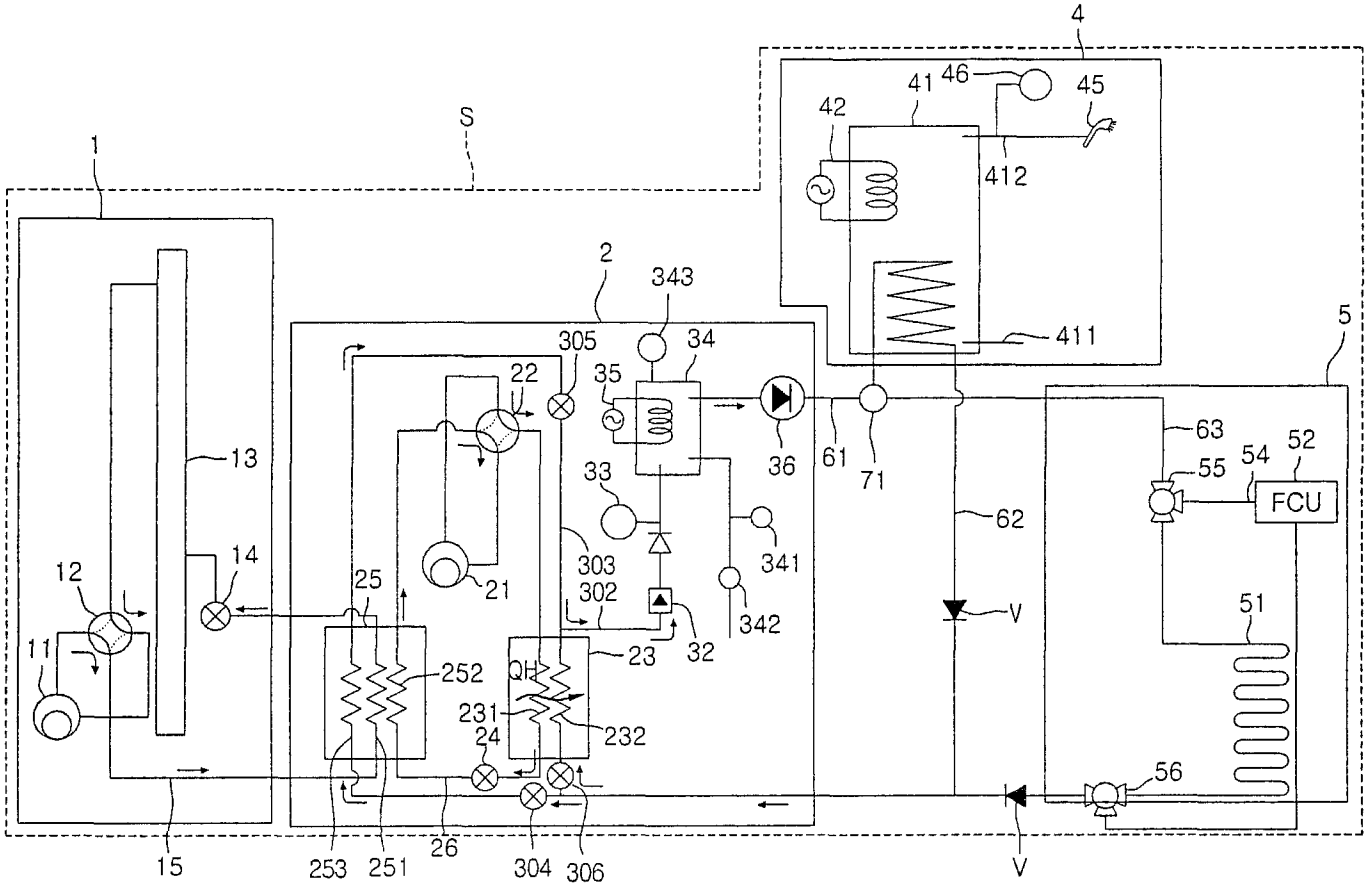
FIG. 4 is a diagram showing the flow of refrigerant when a first embodiment of a water circulation system associated with a refrigerant cycle according to the present invention is operated in one-stage and two-stage mixed compression type.

FIG. 2 is a diagram showing the flow of refrigerant when a first embodiment of a water circulation system associated with a refrigerant cycle according to the present invention is operated in one-stage compression type, FIG. 3 is a diagram showing the flow of refrigerant when a first embodiment of a water circulation system associated with a refrigerant cycle according to the present invention is operated in two-stage compression type, and FIG. 4 is a diagram showing the flow of refrigerant when a first embodiment of a water circulation system associated with a refrigerant cycle according to the present invention is operated in one-stage and two-stage mixed compression type.

Referring to FIGS. 2 to 4, first, the flow of the refrigerant when the water circulation system S associated with the refrigerant cycle operates in a heating mode will be described. The water circulation system S associated with the refrigerant cycle can perform a heating operation in three operation states such as the one-stage compression operation, the two-stage compression operation, and the mixed operation.

Herein, the one-stage compression operation means an operation state in which the water that flows in any one of the hot water supplying unit 4 and the cooling/heating unit 5 is heated by the first refrigerant. The two-stage compression operation means an operation state in which the water that flows in any one of the hot water supplying unit 4 and the cooling/heating unit 5 is heated by the second refrigerant. In addition, the mixed operation means an operation state in which the water that flows in any one of the hot water supplying unit 4 and the cooling/heating unit is heated by the first refrigerant and the second refrigerant at the same time.

That is, in the one-stage compression operation, the water is heated by a single refrigerant cycle performed by the first refrigerant. In addition, in the two-stage compression operation, the second refrigerant is heated by a first refrigerant cycle performed by the first refrigerant and the water is heated by a second refrigerant cycle performed by the second refrigerant. Further, in the mixed operation, the water is heated by two refrigerant cycles performed by the first refrigerant and the second refrigerant at the same time.

More specifically, referring to FIG. 2, first, the flow of the refrigerant when the water circulation system S associated with the refrigerant cycle operates in the one-stage compression type will be described.

In the first refrigerant circulation unit, while the first refrigerant discharged from the first compressor 11 sequentially passes through the intermediate heat exchanger 25, the first expansion unit 14, and the outdoor heat exchanger 13, the refrigerant cycle is performed. At this time, the first flow switch 12 maintains a state to guide the refrigerant discharged from the first compressor 11 to the intermediate heat exchanger 25.

In addition, in the second refrigerant circulation unit, the flow of the refrigerant is stopped. That is, the operation stop of the second compressor 21 is maintained. Further, in the water circulation unit, the water discharged from the water pump 36 is introduced into any one of the hot water supplying unit 4 and the cooling/heating unit 5. The water passing through any one of the hot water supplying unit and the cooling/heating unit 5 is introduced into the branch pipe 303. At this time, the second flow control unit 305 maintains a closed state to prevent the flow of the water to the water refrigerant heat exchanger 23. Further, the first flow control unit 304 and the second flow control unit 305 maintain an opened state.

In addition, the water introduced into the branch pipe 303 passes through the intermediate heat exchanger 25. While the water passes through the intermediate heat exchanger 25, the water is heated by exchange the heat with the first refrigerant. The water passing through the intermediate heat exchanger 25 is again introduced into the water pump 36 through the water collection tank 34.

Next, referring to FIG. 3, first, the flow of the refrigerant when the water circulation system S associated with the refrigerant cycle operates in the two-stage compression type will be described.

In the first refrigerant circulation unit, the flow of the first refrigerant is the same as the case where the water circulation system S associated with the refrigerant cycle operates in the one-stage compression type.

In addition, in the second refrigerant circulation unit, the second refrigerant discharged from the second compressor 21 is introduced into the water refrigerant heat exchanger 23. While the second refrigerant introduced into the water refrigerant heat exchanger 23 passes through the water refrigerant heat exchanger 23, the second refrigerant emits the heat to the water. In addition, the second refrigerant passing through the water refrigerant heat exchanger 23 is expanded while passing through the second expansion unit 24 and thereafter is introduced into the intermediate heat exchanger 25. While the second refrigerant passes through the intermediate heat exchanger 25, the second refrigerant absorbs the heat from the first refrigerant and thereafter, is again introduced into the second compressor 21. At this time, the second flow switch guides the second refrigerant discharged from the second compressor 21 to the water refrigerant heat exchanger 23 and guides the refrigerant passing through the intermediate heat exchanger 25 to the second compressor 21.

Further, in the water circulation unit, the water discharged from the water pump 36 is introduced into any one of the hot water supplying unit 4 and the cooling/heating unit 5. The water passing through any one of the hot water supplying unit 4 and the cooling/heating unit 5 is introduced into the main pipe 302. At this time, the first flow control unit 304 maintains the closed state to prevent the flow of the water to the intermediate heat exchanger 25. Further, the second flow control unit 306 maintains the opened state.

In addition, the water introduced into the main pipe 302 passes through the water refrigerant heat exchanger 23. While the water passes through the water refrigerant heat exchanger 23, the water is heated by exchange the heat with the second refrigerant. The water passing through the water refrigerant heat exchanger 23 is again introduced into the water pump 36 through the water collection tank 34.

In addition, referring to FIG. 4, the flow of the refrigerant when the water circulation system S associated with the refrigerant cycle operates in the mixed compression type will be described.

In the first refrigerant circulation unit and the second refrigerant circulation unit, the flows of the first refrigerant and the second refrigerant are the same as the case where the water circulation system S associated with the refrigerant cycle operates in the two-stage compression type.

However, in the water circulation unit, the water discharged from the water pump 36 is introduced into any one of the hot water supplying unit 4 and the cooling/heating unit 5. The water passing through any one of the hot water supplying unit 4 and the cooling/heating unit 5 is introduced into the main pipe 302 and the branch pipe 303 at the same time. At this time, both the first flow control unit 304 and the second flow control unit 306 maintain the opened state.

The water introduced into the main pipe 302 and the water introduced into the branch pipe 303 pass through the water refrigerant heat exchanger 23 and the intermediate heat exchanger 25, respectively. While the water passes through the intermediate heat exchanger 25, the water is heated by exchanging the heat with the first refrigerant and while the water passes through the water refrigerant heat exchanger 23, the water is heated by exchanging the heat with the second refrigerant. That is, the water is heated by the first refrigerant and the second refrigerant at the same time.

In addition, the water passing through the water refrigerant heat exchanger 23 and the intermediate heat exchanger 25 is again introduced into the water pump 36 through the water collection tank 34.

Next, in the case where the water circulation system S associated with the refrigerant cycle operates in the cooling mode, the first refrigerant and the second refrigerant flow in reverse order in the first refrigerant circulation unit and the second refrigerant circulation unit in comparison with the case where the system operates in the heating mode.

Hereinafter, the shape of an intermediate heat exchanger in a first embodiment of a water circulation system associated with a refrigerant cycle according to the present invention will be described in detail with reference to the accompanying drawings.

Figure 5:
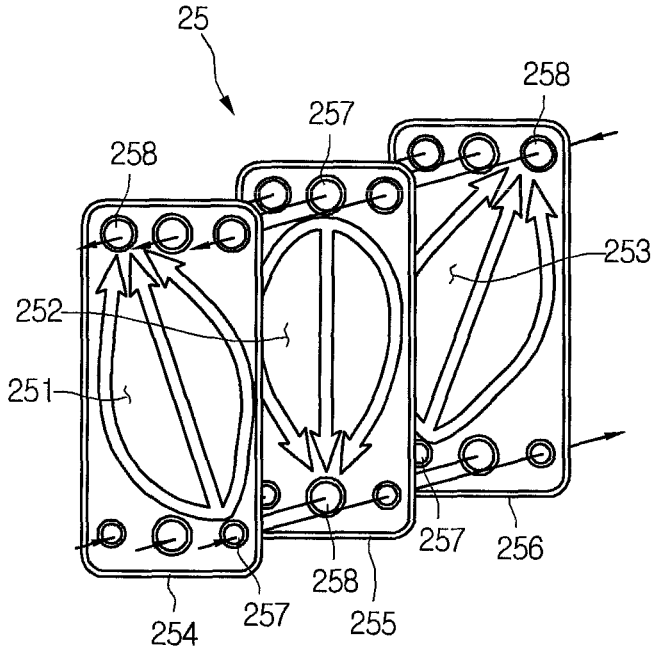
FIG. 5 is a diagram showing the shape of an intermediate heat exchanger in a first embodiment of a water circulation system associated with a refrigerant cycle according to the present invention.

FIG. 5 is a diagram showing the shape of an intermediate heat exchanger in a first embodiment of a water circulation system associated with a refrigerant cycle according to the present invention.

Referring to FIG. 5, the intermediate heat exchanger 25 is a plate-type heat exchanger 25 that includes three flow passages adjacent to each other where the first refrigerant, the second refrigerant, and water flow independently.

In detail, the plate-type heat exchanger 25 includes a plurality of plates 254, 255, and 256 that forms a plurality of flow passages 251, 252, and 253 where the first refrigerant, the second refrigerant, and water flow independently. One side of the plates 254, 255, and 256 is formed with an introduction portion 257 into which any one of the first refrigerant, the second refrigerant, and water is introduced and the other thereof is formed with a discharge portion 258 from which any one of the first refrigerant, the second refrigerant, and water is discharged. In other words, the introduction portion 257 and the discharger portion 258 communicate with the plurality of flow passages 251, 252, and 253. However, each of the plurality of flow passages 251, 252, and 253 communicates with the introduction portion 257 and the discharge portion 258 of any one of the first refrigerant, the second refrigerant, and water so that any one of the first refrigerant, the second refrigerant, and water can flow.

At this time, the first refrigerant flows through any one flow passage 252 that is positioned between the remaining flow passages 251 and 253 among the plurality of flow passages 251, 252, and 253. More specifically, the second refrigerant flows through the first flow passage 251 of the plurality of flow passages 251, 252, and 254, the water flows through the third flow passage 253, and the first refrigerant flows through the second flow passage 252 that is positioned between the first flow passage 251 and the third flow passage 253.

Therefore, even when the water circulation system (S) associated with the refrigerant cycle is operated in any one state of the one-stage compression operation and the mixed operation, the heat exchange performance through the intermediate heat exchanger 25 can be maximized. In more detail, in the one-stage compression operation, the heat exchange of the first refrigerant and water is performed through the intermediate heat exchanger 25, in the two-stage compression operation, the heat exchanger of the second refrigerant and water is performed through the intermediate heat exchanger 25, and in the mixed operation, the heat exchange of the first refrigerant, the second refrigerant, and water is performed through the intermediate heat exchanger 25. Therefore, the first refrigerant and water that flow the intermediate heat exchanger 25 can perform the heat exchanger in the adjacent state to each other regardless of the operation state of the water circulation system (S) associated with the refrigerant cycle.

Hereinafter, a control flow of a first embodiment of a water circulation system associated with a refrigerant cycle according to the present invention will be described in detail with reference to the accompanying drawings.

Figure 6:
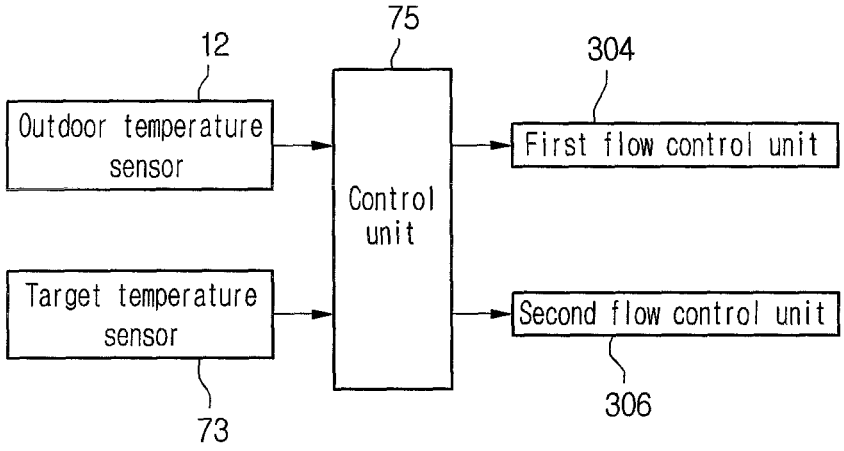
FIG. 6 is a control configuration diagram of a first embodiment of a water circulation system associated with a refrigerant cycle according to the present invention.
Figure 7:
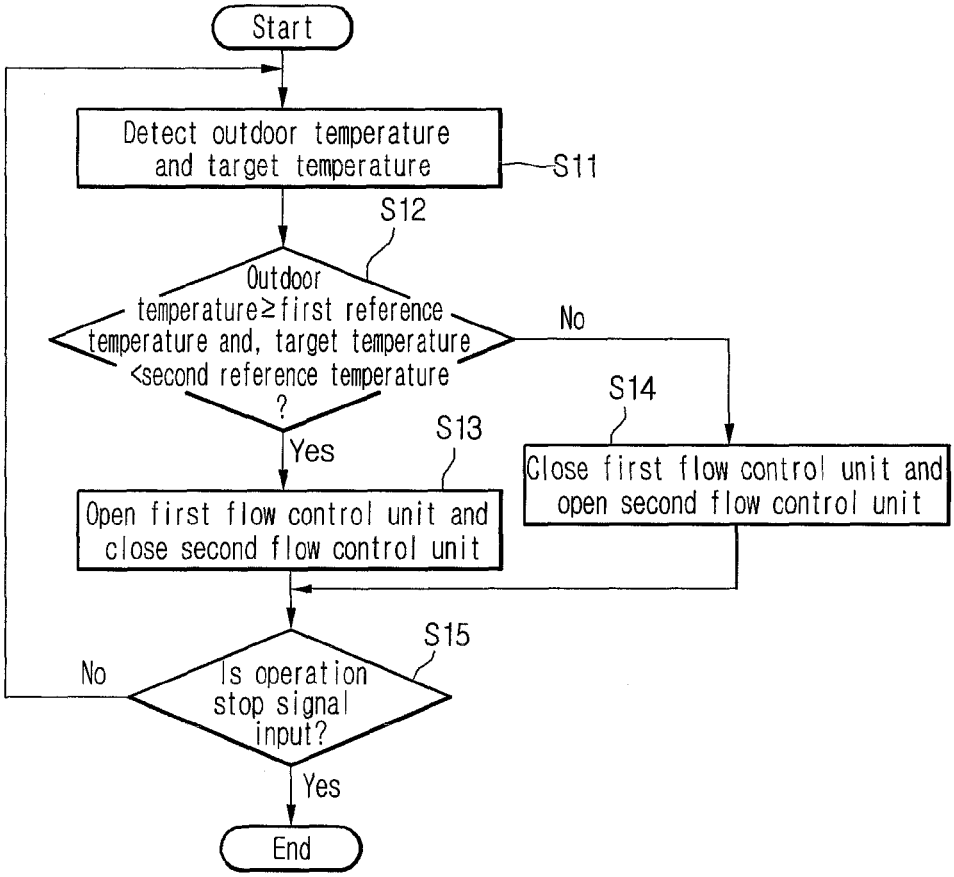
FIG. 7 is a flowchart showing a control flow when the first embodiment of the water circulation system associated with the refrigerant cycle according to the present invention performs a heating operation.
Figure 8:
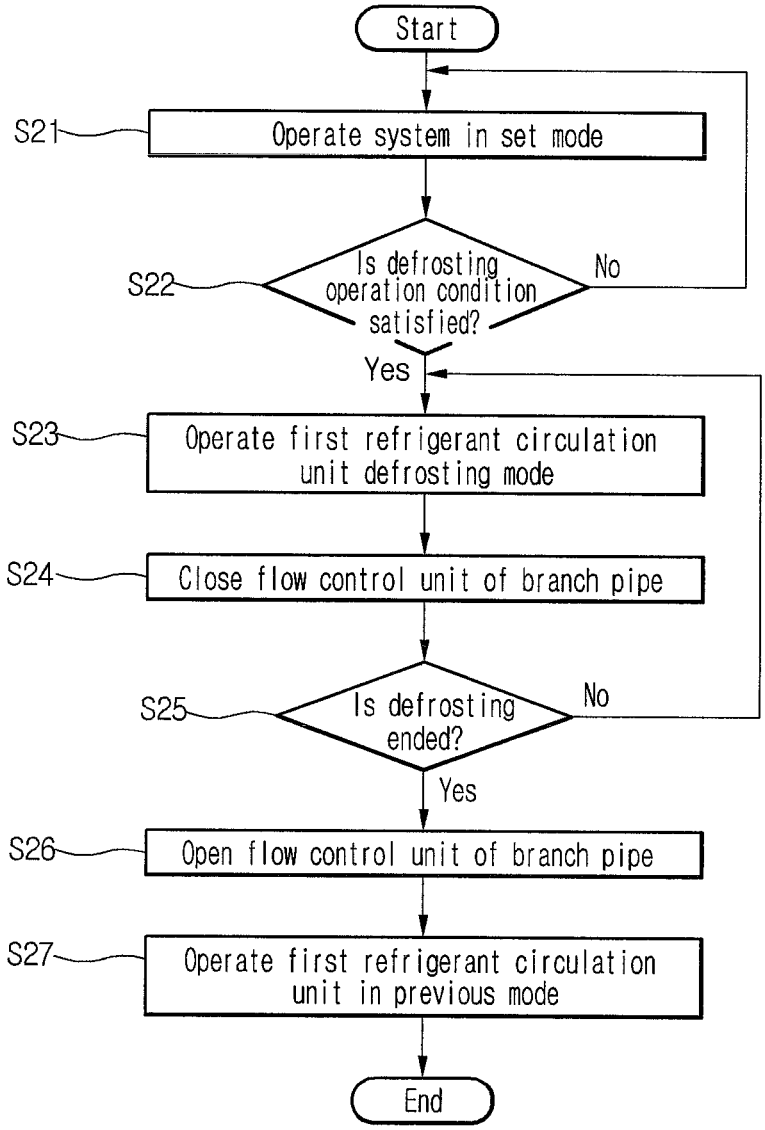
FIG. 8 is a flowchart showing a control flow when the first embodiment of the water circulation system associated with the refrigerant cycle according to the present invention performs a defrosting operation.

FIG. 6 is a control configuration diagram of the first embodiment of the water circulation system associated with the refrigerant cycle according to the present invention, FIG. 7 is a flowchart showing a control flow when the first embodiment of the water circulation system associated with the refrigerant cycle according to the present invention performs a heating operation, and FIG. 8 is a flowchart showing a control flow when the first embodiment of the water circulation system associated with the refrigerant cycle according to the present invention performs a defrosting operation.

Referring to FIG. 6, the water circulation system (S) associated with the refrigerant cycle includes an outdoor temperature sensor 72 that senses the temperature of outdoor air, a target temperature sensor 73 that senses the temperature of a target to be operated by the water circulation system (S) associated with the refrigerant cycle, and a control unit 75 that controls the first flow controller 304 and the second flow controller 306 based on the outdoor air temperature and the target temperature. The outdoor temperature sensor 72, the target temperature sensor 73, the first flow control unit 304, the second flow control unit 306, and the control unit 75 are electrically connected to each other so that they can transmit and receive signals to and from each other.

The target to be operated by the water circulation system (S) associated with the refrigerant cycle means a target to be controlled for the cooling and heating and hot water supplying. For example, the target to be operated may be an indoor temperature that means the temperature of indoor air, a discharge temperature that means a temperature of water discharged from the intermediator 2, an introduction temperature that means the temperature of water introduced into the intermediator 2, etc.

Referring to FIG. 7, when the heating operation of the water circulation system (S) associated with the refrigerant cycle starts, the outdoor temperature that means the temperature of the outdoor air and the target temperature that means the target temperature to be operated are sensed (S11).

When the outdoor temperature is a first reference temperature or more and the target temperature is below a second reference temperature (S12), the first flow control unit 304 is opened and the second flow control unit 306 is closed (S13). However, when the outdoor temperature is a first reference temperature or more and the target temperature is below a second reference temperature (S12), the first flow control unit 304 is opened and the second flow control unit 306 is closed (S14).

The case where the first flow control unit 304 is opened and the second flow control unit 306 is closed corresponds to the one-stage compression operation and the case where the first flow control unit 304 is closed and the second flow control unit 306 is opened corresponds to the two-stage compression operation. Therefore, the case where the outdoor temperature is the first reference temperature or more and the target temperature is below the second reference temperature may be referred to as the one-stage compression condition and the case other than the case where the outdoor temperature is the first reference temperature or more and the target temperature is below the second reference temperature may be referred to as the two-stage compression condition.

At this time, the first reference temperature and the second reference temperature mean the outdoor temperature and the target temperature corresponding to the operation conditions where the efficiency of the water circulation system (S) associated with the refrigerant cycle in the case of the one-stage compression operation and the efficiency of the water circulation system (S) associated with the refrigerant cycle of the two-stage compression operation are identical.

In more detail, as the outdoor temperature is high and the target temperature is low, the efficiency of the case of the one-stage compression operation is higher than the efficiency of the case of the two-stage compression operation. On the other hand, as the outdoor temperature is low and the target temperature is high, the efficiency of the case of the two-stage compression operation is higher than the efficiency of the case of the one-stage compression operation. Therefore, while the outdoor temperature and the target temperature are changed, there may be the outdoor temperature and the target temperature where the efficiency of the case of the two-stage compression operation is the same level of the efficiency of the case of the one-stage compression operation. Therefore, according to the control flow, the operation state of the water circulation system (S) associated with the refrigerant cycle is varied in the direction where the operation efficiency is higher according to the outdoor temperature and the target temperature.

Meanwhile, if the operation stop signal of the water circulation system (S) associated with the refrigerant cycle is not input, the process is repeatedly performed.

According to the water circulation system (S) associated with the refrigerant cycle, the operation efficiency can be maximized. In more detail, when the efficiency of the one-stage compression is operated is higher the efficiency of the case of the two-stage compression operation based on the first reference temperature and the second reference temperature as a reference, the water circulation system (S) associated with the refrigerant cycle is operated in the one-stage compression type and when the efficiency of the two-stage compression operation is higher than the efficiency of the one-stage compression operation, the water circulation system (S) associated with the refrigerant cycle is operated in the two-stage compression type. Therefore, the water circulation system (S) associated with the refrigerant cycle may be operated in the direction where the operation efficiency can be maximized according to the outdoor temperature and the target temperature.

Describing the defrosting operation with reference to FIG. 8, the water circulation system associated with the refrigerant cycle is first operated in a mode set by the user's selection (S21). However, the defrosting operation to be described below is high likely to be need in the environment where the external temperature of the heat exchanger serving as an evaporator is below zero temperature, that is, the winter where the heating operation is mainly performed. Therefore, the water circulation system associated with the refrigerant cycle that performs the defrosting operation during the heating operation as described above will be described.

While the water circulation system associated with the refrigerant cycle performs the heating operation, it is determined whether the defrosting operation condition is satisfied (S22). Whether the defrosting operation condition is operated may be determined by comparing the pipe outlet temperature of the outdoor heat exchanger 13 with the outdoor temperature. However, in the present embodiment, the determination on whether the defrosting operation condition is satisfied may be performed in various methods and therefore, it is to be noted that the present embodiment can use a method for determining whether the defrosting operation is satisfied, without limitation.

When the defrosting operation condition is satisfied, the first refrigerant circulation unit is operated in a defrosting mode and the second refrigerant circulation unit maintains the operation mode (heating mode) (S23).

When the first refrigerant circulation unit is operated in the defrosting mode, the intermediate heat exchanger 25 serves as the evaporator in each refrigerant circulation units 1 and 2 and the outdoor heat exchanger 25 serves as a condenser. Therefore, while the first refrigerant circulation unit is operated in the defrosting mode, the defrosting of the outdoor heat exchanger 13 is performed by the high-temperature refrigerant that flows to the outdoor heat exchanger 13.

At this time, when the intermediate heat exchanger 25 serves as the evaporator of each refrigerant circulation unit, the evaporation pressure of each refrigerant circulation units 1 and 2 becomes small, such that there is a risk of the performance degradation of each refrigerant circulation units 1 and 2 and the damage of each compressor.

Therefore, in the present embodiment, in order to prevent the reduction of the evaporation pressure in the intermediate heat exchanger 25, while the first refrigerant circulation unit is operated in the defrosting mode, the first flow control unit 304 and the third flow control unit 305 are closed (S24). The flow of water stops in the branch pipe 303 and the hot water is heat exchanged with the first refrigerant inside the branch pipe 303. The first refrigerant heat exchanged with the hot water and the second refrigerant is heat exchanged, such that the temperature of each refrigerant is increased, thereby making it possible to minimize the reduction of the evaporation pressure of each refrigerant circulation unit.

Next, while the first refrigerant circulation unit is operated in the defrosting mode, it is determined whether the defrosting is ended (S25).

If it is determined whether the defrosting is ended, the closed first flow control unit 304 and third control unit 305 are opened (S26). The first refrigerant circulation unit is operated in a previous mode (S27). That is, the first refrigerant circulation unit is operated in a heating mode.

According to the above-mentioned embodiment, while the first refrigerant circulation unit is operated in the defrosting mode, the second refrigerant circulation unit is continuously operated in the heating mode, such that the indoor heating or the hot water supplying can be performed. In addition, the hot water of the branch pipe 303 is heat exchanged with the first refrigerant that flows to the intermediate heat exchanger 25 to increase the temperature of the first refrigerant, such that the evaporation pressure of each refrigerant circulation unit is minimized, thereby making it possible to minimize the performance degradation of each refrigerant circulation unit.

Hereinafter, a second embodiment of a water circulation system associated with a refrigerant cycle according to the present invention will be described in detail with reference to the accompanying drawings. The second embodiment is different from the first embodiment in that the intermediate heat exchanger is formed in a triple-pipe, the mixed operation is performed during the reference time in the case of the two-stage compression condition, and the first flow control unit 304 and the third flow control unit 305 are opened during the defrosting operation.

Figure 9:
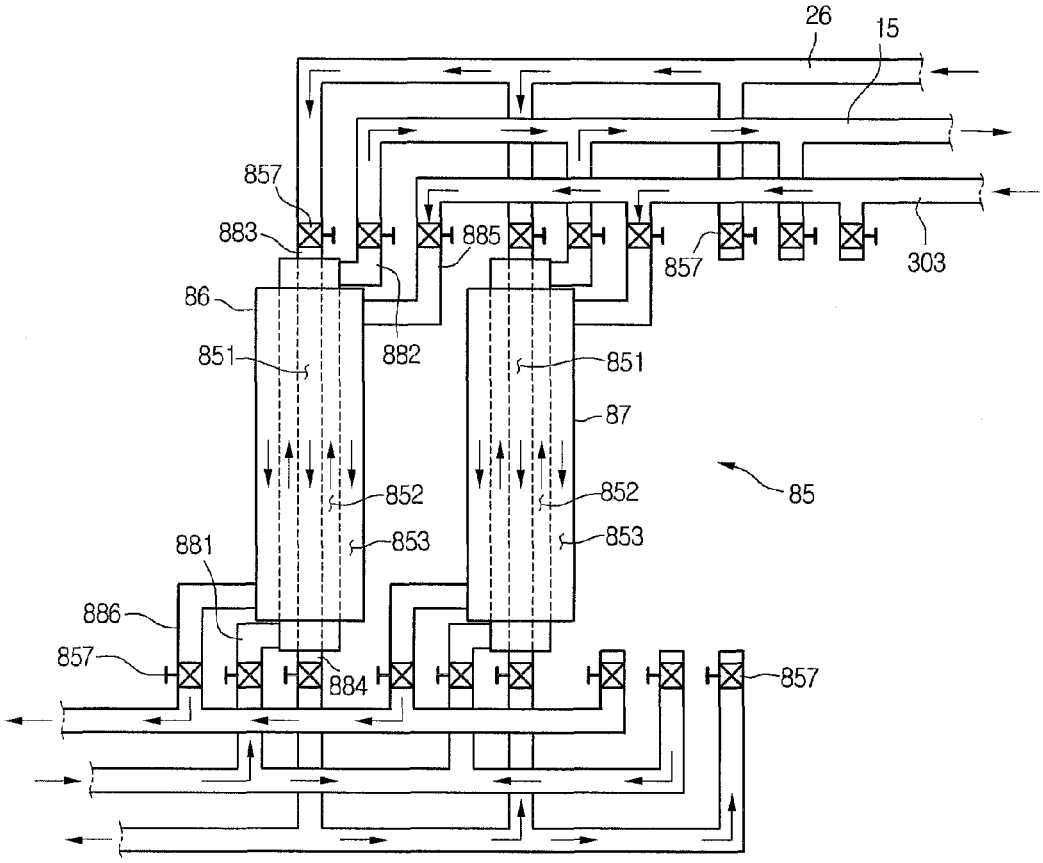
FIG. 9 is a diagram showing the shape of an intermediate heat exchanger in a second embodiment of a water circulation system associated with a refrigerant cycle according to the present invention.
Figure 10:
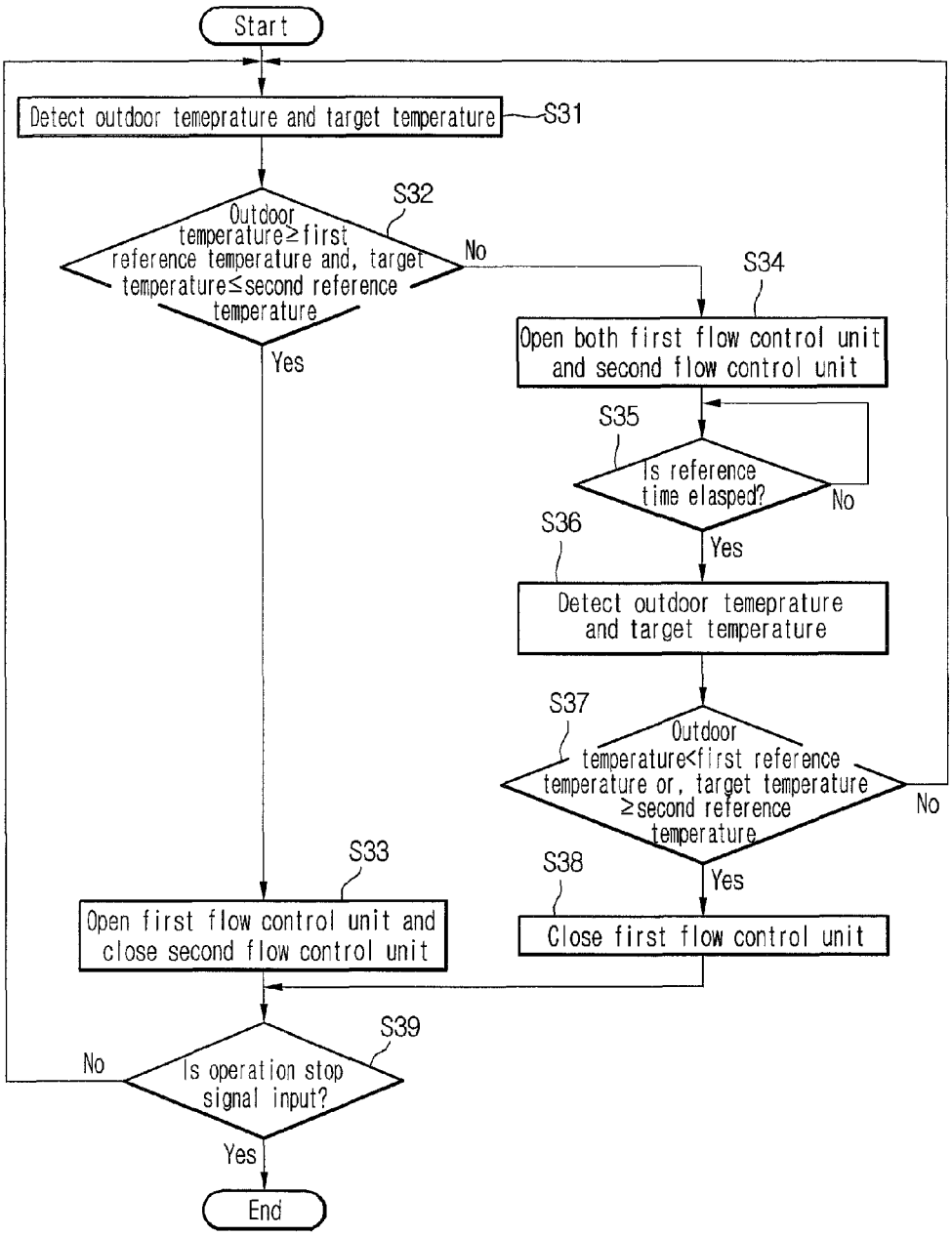
FIG. 10 is a flowchart showing a control flow when the second embodiment of the water circulation system associated with the refrigerant cycle according to the present invention performs a heating operation.
Figure 11:
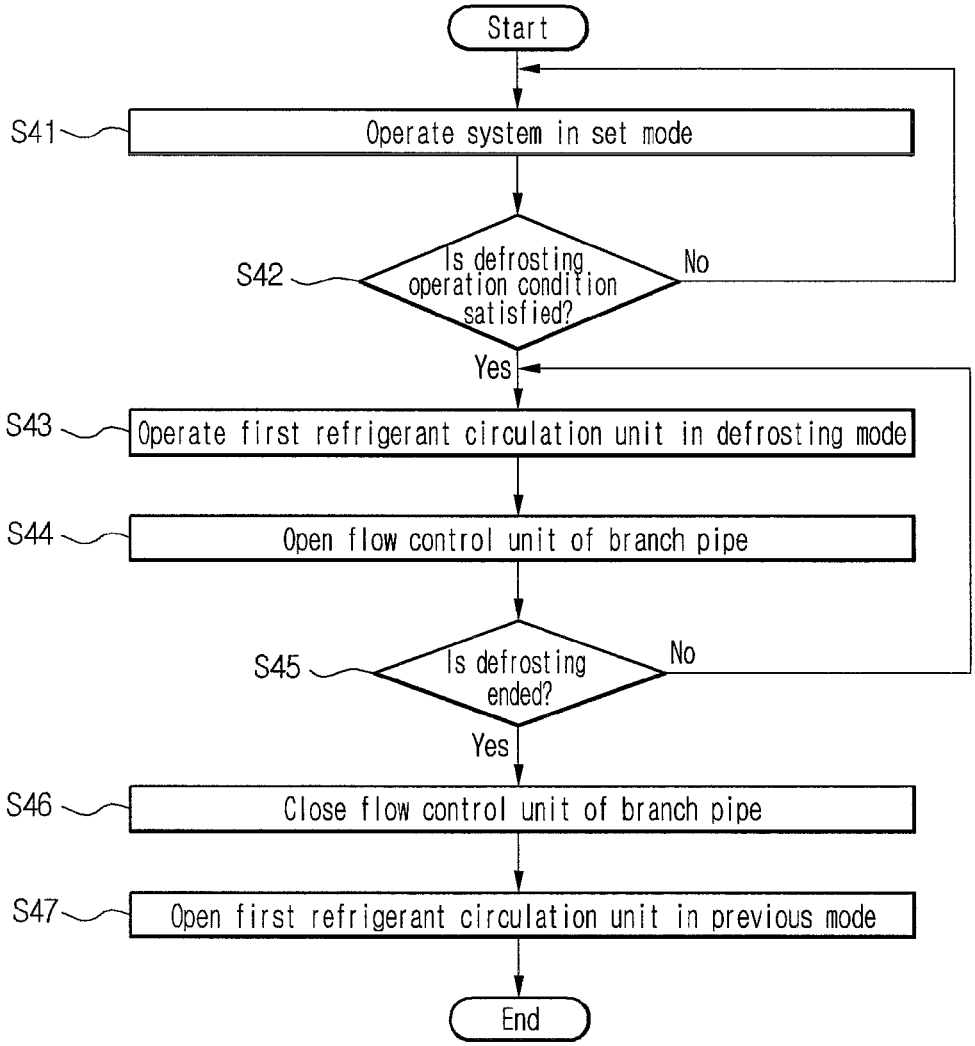
FIG. 11 is a flowchart showing a control flow when the second embodiment of the water circulation system associated with the refrigerant cycle according to the present invention performs a defrosting operation.

FIG. 9 is a diagram showing a shape of the intermediate heat exchanger of the second embodiment of the water circulation system associated with the refrigerant cycle according to the present invention, FIG. 10 is a flowchart showing a control flow when the second embodiment of the water circulation system associated with the refrigerant cycle according to the present invention performs a heating operation, and FIG. 11 is a flowchart showing a control flow when the second embodiment of the water circulation system associated with the refrigerant cycle according to the present invention performs a defrosting operation.

Referring to FIG. 9, in the second embodiment, the intermediate heat exchanger 85 is a triple-pipe shape in which three independent flow passages are formed by three pipes having a concentric axis and different diameters. Specifically, the intermediate heat exchanger 85 includes a first flow passage 851 positioned at the innermost side, a second flow passage 852 positioned outside of the first flow passage 851, and a third flow passage 853 positioned outside of the second flow passage 852. The first flow passage 851 is in communication with a second refrigerant pipe 26 through which second refrigerant flows, the second flow passage 852 is in communication with a first refrigerant pipe 15 through which first refrigerant flows, and the third flow passage 853 is in communication with a water pipe 303 through which water flows. That is, the second refrigerant flows through the first flow passage 851, the first refrigerant flows through the second flow passage 852, and the water flows through the third flow passage 853.

On the other hand, the intermediate heat exchanger 85 includes a plurality of heat exchanging units 86 and 87 that are removably connected with each other. The heat exchanging units 86 and 87 each include three flow passages 851, 852, and 853. Each of the heat exchange units 86 and 87 is connected to the first refrigerant pipe 15, the second refrigerant pipe 26, and the water pipe 303.

At this time, a plurality of introduction portions 881, 883, and 885 and refrigerant discharge portions 882, 884, and 886 that are selectively connected to each of the plurality of heat exchanging units 86 and 87 are provided in the first refrigerant pipe 15, the second refrigerant pipe 26, and the water pipe 303. More specifically, the plurality of introduction portions 881, 883, and 885 and refrigerant discharge portions 882, 884, and 886 include a first refrigerant introduction portion 881 and a first refrigerant discharge portion 882 for introducing and discharging the first refrigerant, a second refrigerant introduction portion 883 and a second refrigerant discharge portion 884 for introducing and discharging the second refrigerant, and a water introduction portion 885 and a water discharge portion 886 for introducing and discharging the water.

In addition, each of the plurality of introduction portion 881, 883, and 885 and discharge portions 882, 884, and 886 includes a plurality of flow preventing portions 857 for selectively shielding the plurality of introduction portion 881, 883, and 885 and discharge portions 882, 884, and 886. The plurality of flow preventing portions 857 selectively prevents the flow of at least one of the first refrigerant, the second refrigerant, and the water through the plurality of introduction portion 881, 883, and 885 and discharge portions 882, 884, and 886.

Meanwhile, the heat exchange capacity of the intermediate heat exchanger 85 may be varied depending on the number of the heat exchanging units 86 and 87 connected to the first refrigerant pipe 15, the second refrigerant pipe 26, and the water pipe 303. Further, as the flow of the refrigerant to the plurality of heat exchanging units 86 and 87 is selectively prevented by the plurality of flow preventing portions 857, the heat exchange capacity of the intermediate heat exchanger 85 may be varied.

More specifically, since the heat exchanging units 86 and 87 are selectively and removably connected to the introduction portions 881, 883, and 885 and the discharge portions 882, 884, and 886, the heat exchanging unit 86 and 87 may be connected to the introduction portions 881, 883, and 885 and the discharge portions 882, 884, and 886 by changing the number of connected portions as necessary.

Further, by preventing the flow of the first refrigerant, the second refrigerant, and the water to the heat exchanging units 86 and 87 by means of the flow preventing portion 857 even in the state where the heat exchanging units 86 an 87 are connected to the introduction portions 881, 883, and 885 and the discharge portions 882, 884, and 886, the number of the heat exchanging units 86 and 87 substantially used for exchanging the heat may be varied. By this method, the entire heat exchanging capacity of the intermediate heat exchanger 85 may be varied. By this method, the entire heat exchanging capacity of the intermediate heat exchanger 85 may be varied.

Meanwhile, the type in which the first refrigerant, the second refrigerant, and the water flows through three flow passages 851, 852, and 853 has various numbers of cases. That is, the first refrigerant flows through any one of three flow passages 851, 852, and 853, the second refrigerant flows through another of three flow passages 851, 852, and 853, and the water flows through the other one of three flow passages 851, 852, and 853. Accordingly, the first refrigerant, the second refrigerant, and the water may flow through three flow passages 851, 852, and 853 in six types.

Further, the flow directions of fluids that flow through adjacent flow passages among the fluids that flow through three flow passages 851, 852, and 853 are opposite to each other. At this time, the fluids include the first refrigerant, the second refrigerant, and the water. That is, two fluids that flow adjacent to each other among the first refrigerant, the second refrigerant, and the water flow opposite to each other in the intermediate heat exchanger 85. Accordingly, the heat exchange efficiency of the intermediate heat exchanger 85 can further be improved.

Referring to FIG. 10, in the present embodiment, the mixed operation is performed during the reference time in the case corresponding to the two-stage compression condition.

In detail, when the operation of the water circulation system (S) associated with the refrigerant cycle starts, the outdoor temperature and the target temperature are sensed (S31). In the case where the outdoor temperature and the target temperature correspond to the one-stage compression condition (S32), the first flow control unit 304 is opened and the second flow control unit 306 is closed, such that the one-stage compression operation starts (S33).

However, when the outdoor temperature and the target temperature does not correspond to the one-stage compression condition, that is, when they correspond to the two-stage compression condition (S32), both the first flow control unit 304 and the second flow control unit 306 are opened, such that the mixed operation starts (S34).

After the mixed operation starts and the reference time elapses (S35), the outdoor temperature and the target temperature are sensed (S36). When the outdoor temperature and the target temperature still correspond to the two-stage compression condition (S37), the first flow control unit 304 is closed, such that the two-stage compression operation starts (S38). However, when the outdoor temperature and the target temperature are changed in the one-stage compression condition (S37), the outdoor temperature and the target temperature are sensed again (S31). At this time, the reference time means the time required from the time when the first flow control unit 304 and the second flow control unit 306 are switched to the time when the outdoor temperature and the target temperature are stabilized.

If the operation stop signal of the water circulation system (S) associated with the refrigerant cycle is not input, the process is repeatedly performed.

According to the present embodiment, the efficiency of the water circulation system (S) associated with the refrigerant cycle can be optionally maintained according to the change in the outdoor temperature and the target temperature.

In more detail, even when the outdoor temperature and the target temperature correspond to the two-stage compression condition, the efficiency of the mixed operation may be higher than that of the two-stage compression operation. For example, when the outdoor temperature and the target temperature have a value approximating to the first reference temperature and the second reference temperature, the efficiency of the mixed operation may be higher than that of the two-stage compression.

However, in the present embodiment, when the outdoor temperature and the target temperature deviates from the one-stage compression condition, the mixed operation is primarily performed during the reference time and despite of the mixed operation, when they does not enter the one-stage compression condition, the two-stage compression operation is finally performed. Therefore, the efficiency of the water circulation system (S) associated with the refrigerant cycle can be optionally maintained according to the outdoor temperature and the target temperature.

Describing the defrosting operation with reference to FIG. 11, the water circulation system associated with the refrigerant cycle is first operated in a mode set by the user's selection (S41). However, the case where the present embodiment performs the defrosting operation during the heating operation will be described below.

The first flow control unit 304 and the third flow control unit 305 of the branch pipe 303 maintain the closed state while each of the refrigerant circulation units 1 and 2 performs the heating operation. Further, the second flow control unit 306 maintains the opened state. Therefore, the water passing through the water circulation unit is heat exchanged with the second refrigerant while passing through the water refrigerant heat exchanger 23.

When the second refrigerant circulation unit is operated in the heating mode, the temperature of water flowing to the water pipe 61 is continuously increased. In particular, the temperature of water flowing to the main pipe 302 adjacent to the water refrigerant heat exchanger 23 is continuously increased.

It is determined whether the defrosting operation condition is satisfied while the water circulation system is operated in the set mode (S42). When the defrosting operation condition is satisfied, the first refrigerant circulation unit is operated in the defrosting mode and the second refrigerant circulation unit maintains the original operation mode (heating mode).

When the first refrigerant circulation unit is operated in the defrosting mode, the first flow control unit 304 and the third flow control unit 305 are opened (S14). When the first flow control unit 304 and the third flow control unit 305 are opened, at least a part of the hot water flowing to the water circulation unit is heat exchanged with the first refrigerant while flowing to the intermediate heat exchanger 25. The first refrigerant heat exchanged with the hot water and the second refrigerant is heat exchanged, such that the temperature of each refrigerant is increased, thereby making it possible to minimize the reduction of the evaporation pressure of each refrigerant circulation unit.

Next, while the first refrigerant circulation unit is operated in the defrosting mode, it is determined whether the defrosting is ended (S45). If it is determined whether the defrosting is ended, the closed first flow control unit 304 and third control unit 305 are closed (S46). The first refrigerant circulation unit is operated in a previous mode (S47). That is, the first refrigerant circulation unit will be operated in the heating mode.

In addition to the above-mentioned two embodiments, the following embodiment will be described.

When the first refrigerant circulation unit is operated in the defrosting mode while each of the refrigerant circulation units 1 and 2 is operated in the heating mode, if the first flow control unit 304 and the third flow control unit 305 are in the closed state, the first flow control unit 204 and the third flow control unit 305 are opened and if the defrosting is ended, the first flow control unit 304 and the third flow control unit 305 can be closed. On the other hand, if the first flow control unit 304 and the third flow control unit 305 are in the opened state, the first flow control unit 304 and the third flow control unit 305 may be maintained in the opened state.

Hereinafter, a fourth embodiment of a water circulation system associated with a refrigerant cycle according to the present invention will be described in detail with reference to the accompanying drawings. The fourth embodiment is different from the first embodiment in that the flowing amount of water to the intermediate heat exchanger and the water refrigerant heat exchanger is controlled according to the outdoor temperature and the target temperature and when the defrosting operation is performed, it is opposite to the case of the heating operation in terms of the refrigerant flowing of the first refrigerant circulation unit and the second circulation unit.

Figure 12:
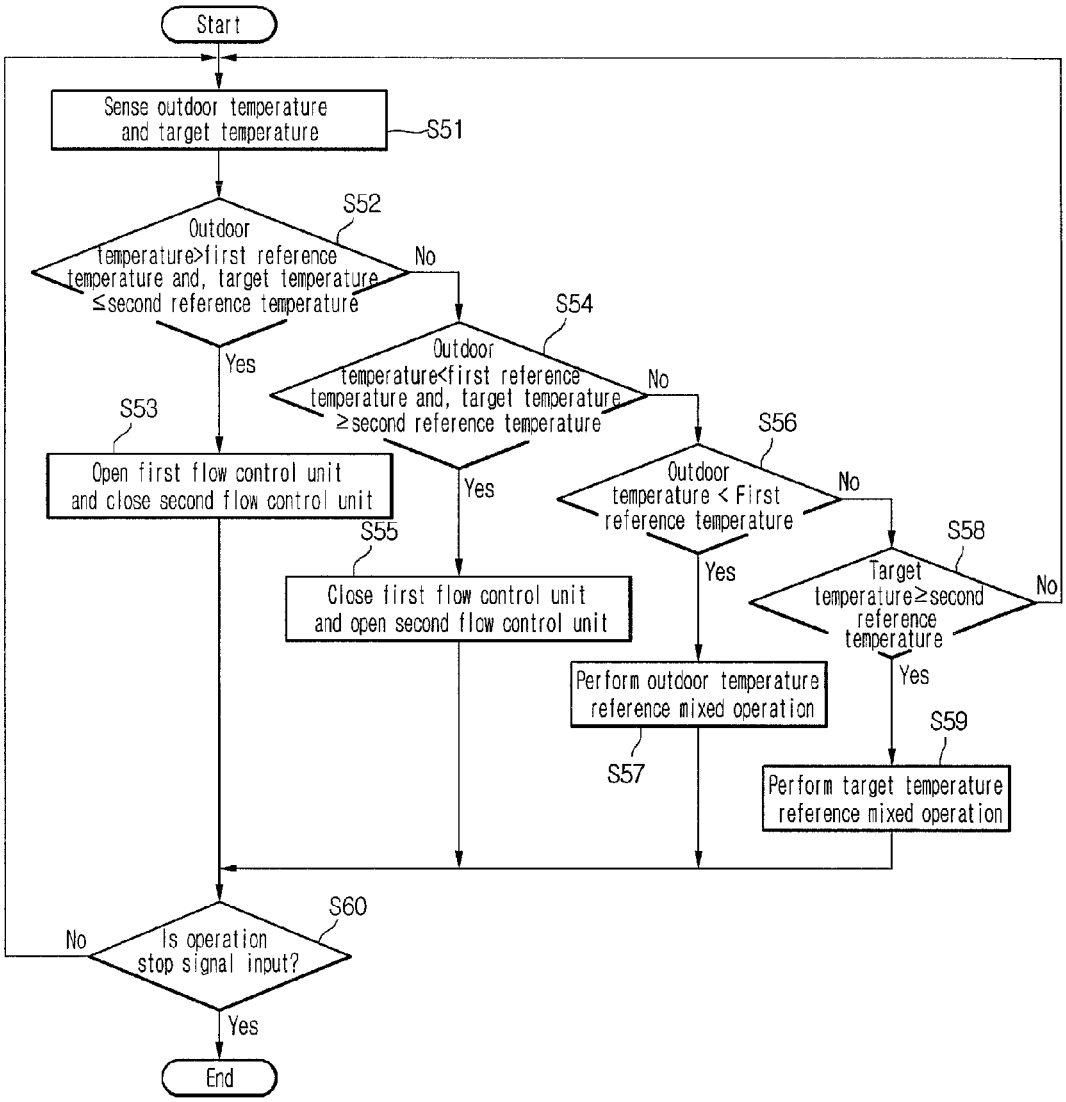
FIG. 12 is a flowchart showing a control flow when a third embodiment of a water circulation system associated with a refrigerant cycle according to the present invention performs a heating operation.
Figure 13:
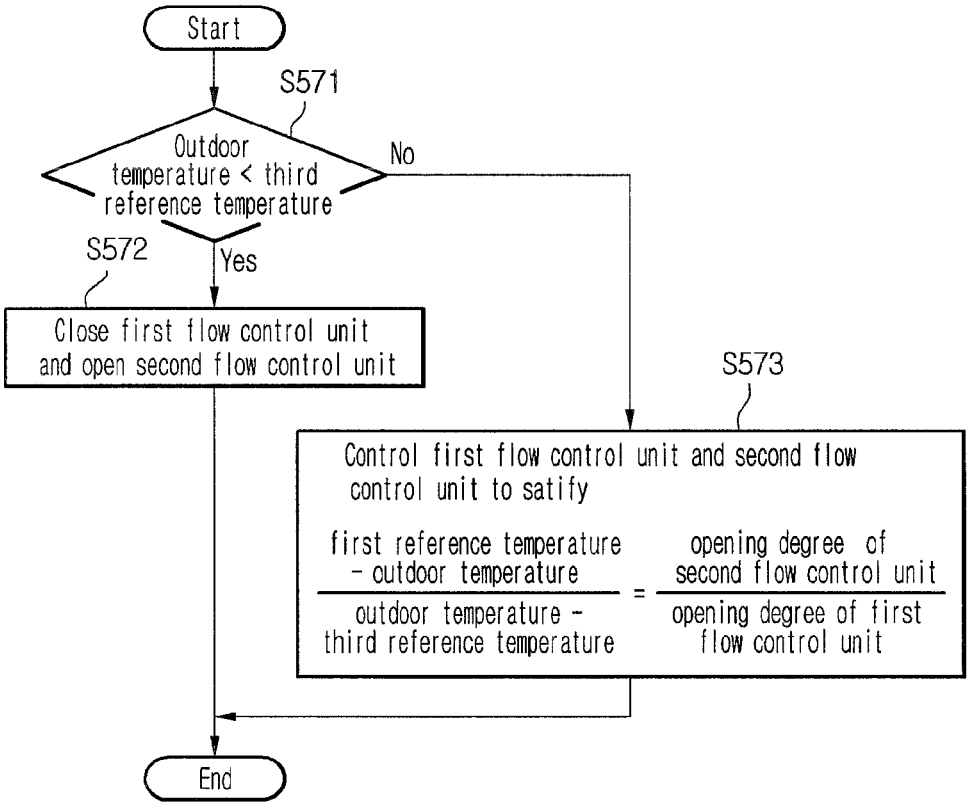
FIG. 13 is a flowchart showing a mixed operation process based on an outdoor temperature in the third embodiment of the water circulation system associated with the refrigerant cycle according to the present invention.
Figure 14:
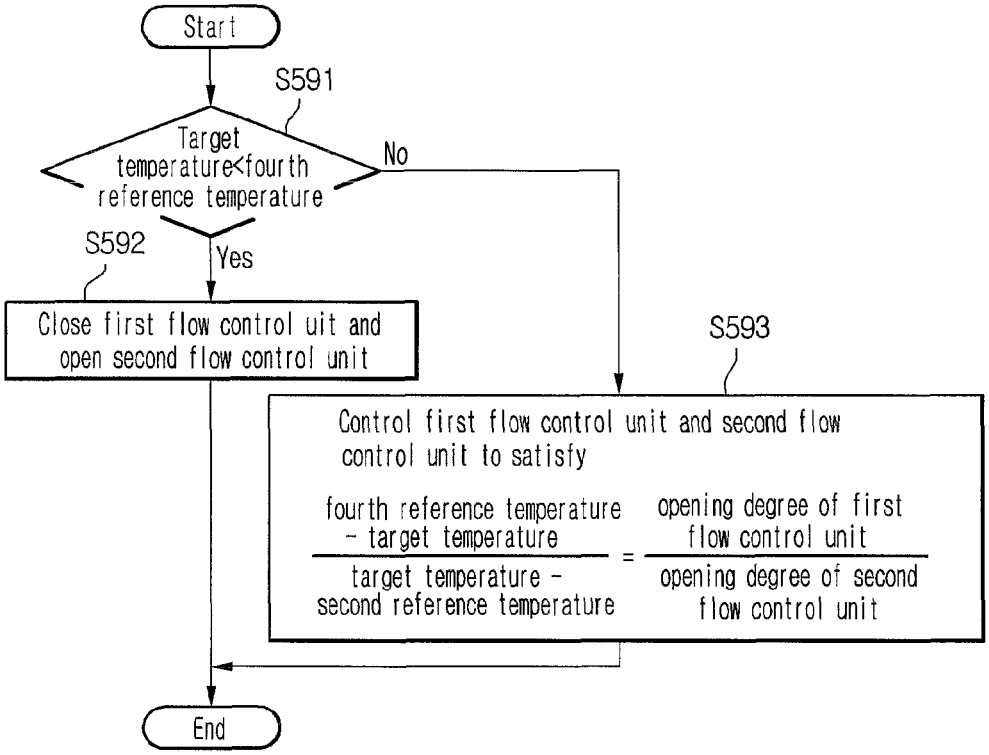
FIG. 14 is a flowchart showing a mixed operation process based on a target temperature in the third embodiment of the water circulation system associated with the refrigerant cycle according to the present invention.
Figure 15:
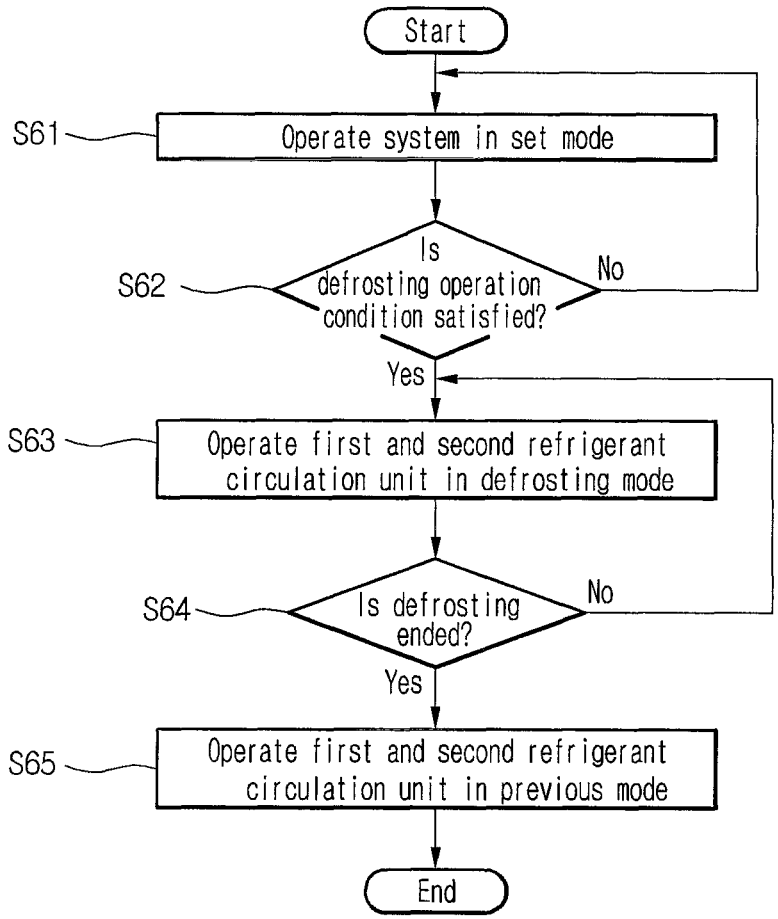
FIG. 15 is a flowchart showing a control flow when the third embodiment of the water circulation system associated with the refrigerant cycle according to the present invention performs a defrosting operation.

FIG. 12 is a flowchart showing a control flow when a third embodiment of a water circulation system associated with a refrigerant cycle according to the present invention performs a heating operation and FIG. 13 is a flowchart showing a mixed operation process based on an outdoor temperature in the third embodiment of the water circulation system associated with the refrigerant cycle according to the present invention. FIG. 14 is a flowchart showing a mixed operation process based on a target temperature in the third embodiment of the water circulation system associated with the refrigerant cycle according to the present invention and FIG. 15 is a flowchart showing a control flow when the third embodiment of the water circulation system associated with the refrigerant cycle according to the present invention performs a defrosting operation.

Referring to FIGS. 12 to 14, in the present embodiment, when the water circulation system (S) associated with the refrigerant cycle performs the mixed operation, the flowing amount of water to the intermediate heat exchanger 25 and the water refrigerant heat exchanger 23 is controlled according to the outdoor temperature and the target temperature.

In detail, when the operation of the water circulation system (S) associated with the refrigerant cycle starts, the outdoor temperature and the target temperature are sensed (S51). In the case where the outdoor temperature and the target temperature correspond to the one-stage compression condition (S52), the first flow control unit 304 is opened and the second flow control unit 306 is closed, such that the one-stage compression operation starts (S53).

However, the case other than the case where the outdoor temperature and the target temperature corresponds to the one-stage compression condition (S52), it determines whether the outdoor temperature is below the first reference temperature and the target temperature is the second reference temperature or more (S54). However, when the outdoor temperature is below the first reference temperature and the target temperature is the second reference temperature or more (S54), the first flow control unit 304 is closed and the second flow control unit 306 is opened (S55).

Herein, the state where the first flow control unit 304 is closed and the second flow control unit 306 is opened means the two-stage compression operation. Therefore, the case where the outdoor temperature is below the first reference temperature and the target temperature is the second reference temperature or more may be referred to the two-stage compression condition.

However, the case where the outdoor temperature and the target temperature do not correspond to the two-stage compression condition (S54), it determines whether the outdoor temperature is below the first reference temperature (S56) and the target temperature is the second reference temperature or more (S58).

The case where the outdoor temperature and the target temperature do not correspond to the two-stage compression condition (S54) and the outdoor temperature is below the first reference temperature (S56) or the target temperature is the second reference temperature or more (S58) may be referred to the mixed condition.

The case where the outdoor temperature and the target temperature do correspond to the mixed condition (S56 and S58), the mixed operation starts (S57 and S59). The mixed operation includes the outdoor temperature reference mixed operation and the target temperature reference mixed operation.

In more detail, the case where the outdoor temperature and the target temperature do not correspond to the two-stage compression condition and the outdoor temperature is below the first reference temperature may be referred to as the outdoor temperature reference mixed condition and the case where the outdoor temperature and the target temperature do not correspond to the two-stage compression condition and the target temperature is the second reference temperature or more may be referred to as the target temperature reference mixed condition. When the outdoor temperature and the target temperature corresponds to the outdoor temperature reference mixed condition (S56), the outdoor temperature reference mixed operation is performed (S57) and when they corresponds to the target temperature reference mixed condition (S58), the target temperature reference mixed operation is performed (S59).

Referring to FIG. 11, when the outdoor temperature reference mixed operation is performed, it determines whether the outdoor temperature is below the third reference temperature (S571). When the outdoor temperature is below the third reference temperature, the two-stage compression operation is performed (S572).

However, when the outdoor temperature corresponds to the third reference temperature or more (S571), the opening degrees of the first flow control unit 304 and the second flow control unit 306 are controlled so that the ratio of the difference of the first reference temperature and the outdoor temperature with respect to the difference of the first reference temperature and the third reference temperature is the same as the ratio of the opening degree of the second flow control unit 306 with respect to the opening degree of the first flow control unit 304 (S573).

At this time, the third reference temperature means the outdoor temperature that makes the efficiency of the mixed operation and the efficiency of the two-stage compression operation same. In other words, when the outdoor temperature is higher than the third reference temperature, the efficiency of the mixed operation is higher than that of the two-stage compression operation. To the contrary, when the outdoor temperature is lower than the third reference temperature, the efficiency of the two-stage compression operation is higher than that of the mixed operation. The third reference temperature corresponds to a temperature value smaller than the first reference temperature.

Referring to FIG. 12, when the target temperature reference mixed operation is performed, it determines whether the target temperature corresponds to a fourth reference temperature or more (S591). When the outdoor temperature corresponds to the fourth reference temperature or more, the two-stage compression operation is performed (S592).

However, when the outdoor temperature is below the fourth reference temperature (S591), the opening degrees of the first flow control unit 304 and the second flow control unit 306 are controlled so that the ratio of the difference of the first reference temperature and the outdoor temperature with respect to the difference of the fourth reference temperature and the second reference temperature is the same as the ratio of the opening degree of the second flow control unit 306 with respect to the opening degree of the second flow control unit 306 (S593).

At this time, the fourth reference temperature means the target temperature that makes the efficiency of the mixed operation and the efficiency of the two-stage compression operation same. In other words, when the target temperature is higher than the fourth reference temperature, the efficiency of the two-stage compression operation is higher than that of the mixed operation. To the contrary, when the target temperature is lower than the fourth reference temperature, the efficiency of the mixed operation is higher than that of the two-stage compression operation. The fourth reference temperature corresponds to a temperature value higher than the second reference temperature.

According to the present embodiment, the operation efficiency of the water circulation system (S) associated with the refrigerant cycle can be more optimized according to the change in the outdoor temperature and the target temperature. In detail, in the case of the mixed condition, the opening degrees of the first flow control unit 304 and the second flow control unit 306 are varied according to any one of the difference of the outdoor temperature and the third reference temperature and the difference of the target temperature and the fourth reference temperature.

In detail, in the case of the outdoor temperature reference mixed condition, as the outdoor temperature approaches to the first reference temperature, the opening degree of the first flow control unit 304 is relatively increased compared to the opening degree of the second flow control unit 306. In other words, as the outdoor temperature approaches to the first reference temperature, the water circulation system (S) associated with the refrigerant cycle is operated in a state close to the one-stage compression operation. To the contrary, when the outdoor temperature approaches to the third reference temperature, the opening degree of the second flow control unit 306 is relatively increased compared to the opening degree of the first flow control unit 304. In other words, as the outdoor temperature approaches to the third reference temperature, the water circulation system (S) associated with the refrigerant cycle is operated in a state close to the two-stage compression operation.

In detail, in the case of the target temperature reference mixed condition, as the target temperature approaches to the second reference temperature, the opening degree of the first flow control unit 304 is relatively increased compared to the opening degree of the second flow control unit 306. In other words, as the target temperature approaches to the second reference temperature, the water circulation system (S) associated with the refrigerant cycle is operated in a state close to the one-stage compression operation. To the contrary, when the outdoor temperature approaches to the fourth reference temperature, the opening degree of the second flow control unit 306 is relatively increased compared to the opening degree of the first flow control unit 304. In other words, as the outdoor temperature approaches to the fourth reference temperature, the water circulation system (S) associated with the refrigerant cycle is operated in a state close to the two-stage compression operation.

In other words, in the case of satisfying the mixed operation, the flowing amount of water to the intermediate heat exchanger 25 and the flowing amount of water to the water refrigerant heat exchanger 23 are varied to be in inverse proportion to each other.

Therefore, the water circulation system (S) associated with the refrigerant cycle can be optionally operated according to the outdoor temperature and the target temperature.

Describing the defrosting operation with reference to FIG. 15, the water circulation system (S) associated with the refrigerant cycle is first operated in a mode set by the user's selection (S61). The case where the defrosting operation is performed during the heating operation will be described below.

It is determined whether the defrosting operation condition is satisfied while the water circulation system (S) is operated in the set mode (S62). If the defrosting operation condition is satisfied, both the first refrigerant circulation unit and the second refrigerant circulation unit are operated in the defrosting mode (S63).

In the present embodiment, the case where the first refrigerant circulation unit is operated in the defrosting mode means the case where the first refrigerant circulation unit is operated in the cooling mode.

The case where the second refrigerant circulation unit is operated in the defrosting mode means the following two cases. The first case means the case where the operation of the second refrigerant circulation unit stops and the second case means the case where the second compressor 21 is operated at a lower frequency than the operation frequency of the second compressor in the previous mode while the second refrigerant circulation unit is basically operated in the heating mode.

In the first case, when the second refrigerant circulation unit is operated in the heating mode, if the first flow control unit 304 and the third flow control unit 305 are opened, the first flow control unit 304 and the third flow control unit 305 are closed. As described in the first embodiment, when the first flow control unit 304 and the third flow control unit 305 are closed, the hot water inside the branch pipe 303 and the first refrigerant are heat exchanged with each other.

In the second case, when the second refrigerant circulation unit is operated in the heating mode, the first flow control unit 304 and the third flow control unit 305 may be the closed state or the opened stated and the opening or closing of the first flow control unit 304 and the third flow control unit 305 can be controlled in the method described in the previous embodiments when the first refrigerant circulation units 1 and 2 are operated in the defrosting mode.

According to the two cases, it can be easily appreciated that the reduction of the evaporation pressure of each refrigerant circulation units 1 and 2 can be minimized. Next, while each refrigerant circulation unit is operated in the defrosting mode, it is determined whether the defrosting is ended (S64). When the defrosting is ended, each refrigerant circulation unit is operated in the previous mode (S65). That is, each refrigerant circulation unit will be operated in the heating mode.

Hereinafter, a fifth embodiment of a water circulation system associated with a refrigerant cycle according to the present invention will be described in detail with reference to the accompanying drawings. The fifth embodiment is different from the first embodiment in that the first flow control unit and the second flow control unit are controlled according to the operation or not of the second compressor and the flowing amount of water flowing to the water circulation unit is reduced during the defrosting operation.

Figure 16:
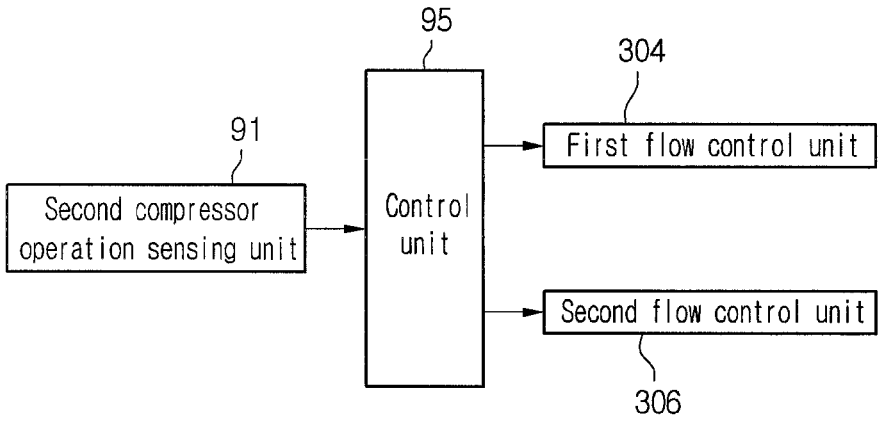
FIG. 16 is a control configuration diagram of a fourth embodiment of a water circulation system associated with a refrigerant cycle according to the present invention.
Figure 17:
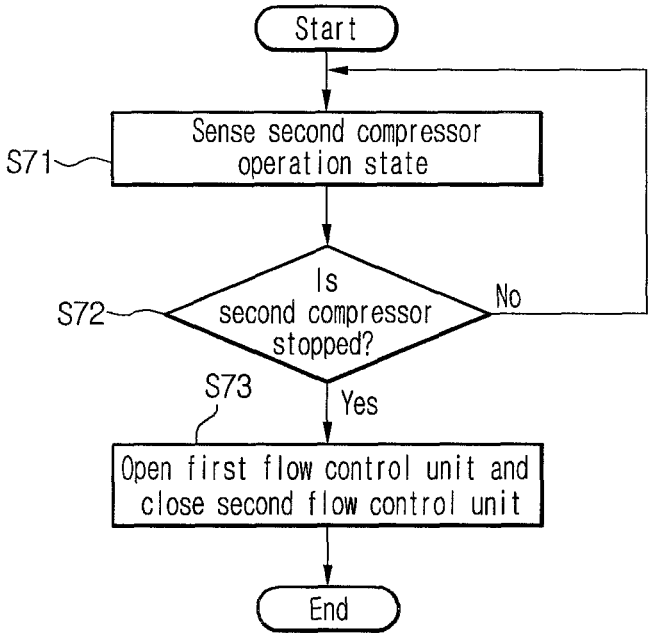
FIG. 17 is a flowchart showing a control flow when the fourth embodiment of the water circulation system associated with the refrigerant cycle according to the present invention performs a heating operation.
Figure 18:
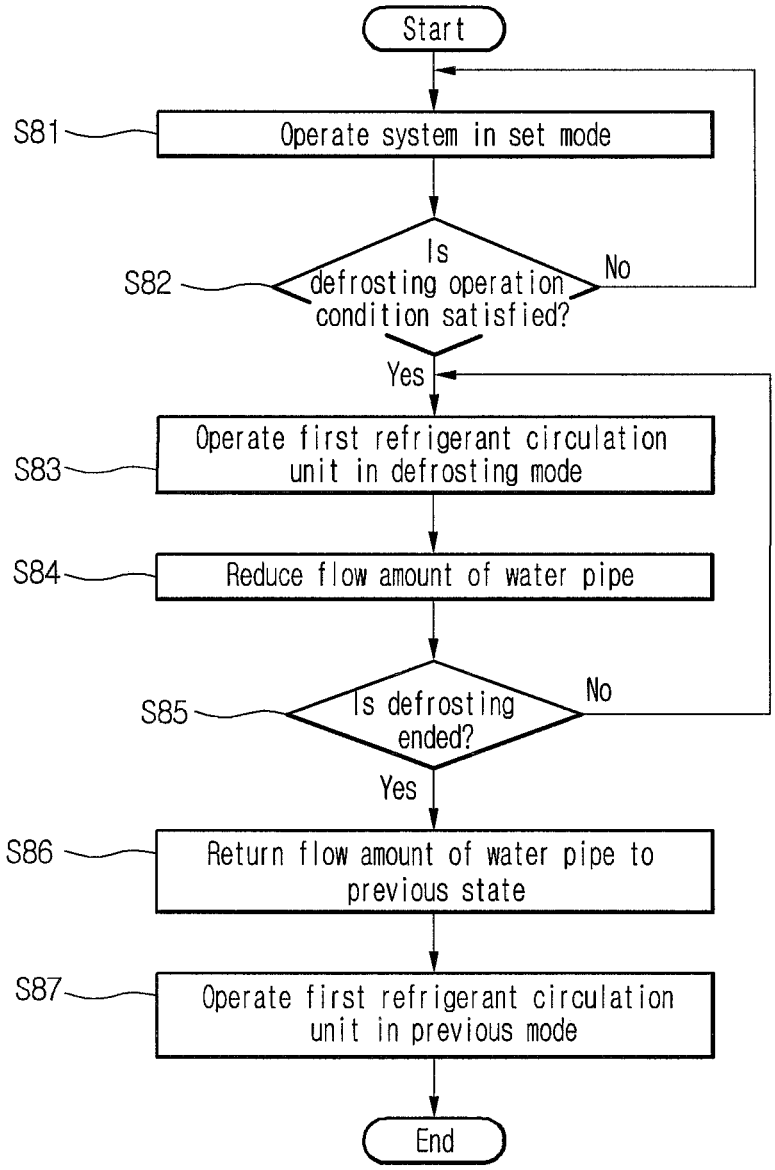
FIG. 18 is a flowchart showing a control flow when the fourth embodiment of the water circulation system associated with the refrigerant cycle according to the present invention performs a defrosting operation.

FIG. 16 is a control configuration diagram of a fourth embodiment of a water circulation system associated with a refrigerant cycle according to the present invention, FIG. 17 is a flowchart showing a control flow when the fourth embodiment of the water circulation system associated with the refrigerant cycle according to the present invention performs a heating operation, and FIG. 18 is a flowchart showing a control flow when the fourth embodiment of the water circulation system associated with the refrigerant cycle according to the present invention performs a defrosting operation.

Referring to FIGS. 16 and 17, in the present embodiment, the first flow control unit 304 and the second flow control unit 306 are controlled according to the operation or not of the second compressor 21. In other words, the present embodiment includes a second compressor operation sensing unit 91 that senses the operation or not of the second compressor 21 and transmits it to the control unit 95.

In more detail, when the operation of the water circulation system (S) associated with the refrigerant cycle starts, the operation of the second operation 21 is sensed (S71). At this time, as a method of sensing the operation of the second compressor 21, there may be a rotation sensor that senses the rotation or not of the compressor or a method for sensing the current or voltage supplied to the compressor, etc.

When the operation of the second compressor 21 stops (S72), the first flow control unit 304 is opened and the second flow control unit 306 is closed (S73). In other words, when it is sensed as the operation of the second compressor stops, the one-stage compression operation is performed (S73).

As the case where the operation of the second compressor 21 stops, there may be various situations such as the malfunction or fault of the second compressor 21, etc. Since the flowing of the second refrigerant stops in the state where the second compressor 21 stops, the water introduced into the water refrigerant heat exchanger 23 passes therethrough without the change in state. In this case, the water continuously flows to the water refrigerant heat exchanger 23, which may have a bad effect on the operation for the indoor cooling and heating and the hot water supplying.

In the present embodiment, when the second compressor 21 stops, the flowing of water to the water refrigerant heat exchanger 23 is prevented. Therefore, even though a sudden situation such as the case of the failure of the second compressor 21 occurs, the indoor cooling and heating or the hot water supplying operations can be stably continued. Describing the defrosting operation of the embodiment with reference to FIG. 18, the water circulation system (S) associated with the refrigerant cycle is first operated in a mode set by the user's selection (S81).

It is determined whether the defrosting operation condition is satisfied while the water circulation system (S) is operated in the set mode (S82). When the defrosting operation condition is satisfied, the first refrigerant circulation unit is operated in the defrosting mode and the second refrigerant circulation unit maintains the original operation mode (heating mode) (S83).

When the first refrigerant circulation unit is operated in the defrosting mode, the intermediate heat exchanger 25 serves as the evaporator for each refrigerant circulation units 1 and 2.

At this time, the intermediated heat exchanger serves as the evaporator for each refrigerant circulation unit, such that the evaporation pressure of each refrigerant circulation unit becomes small, thereby makes the condensing temperature of the second heat exchanger 23 low. When the condensing temperature of the second heat exchanger 23 is low, the temperature of water stored in the water collection tank 34 is low.

When the temperature of water stored in the water collection tank 34 is low, the temperature of water flowing to the cooling and heating pipe 63 of the cooling and heating unit 5 is low, such that the indoor temperature may be low. Therefore, in the present embodiment, when the first refrigerant circulation unit is operated in the defrosting modes, the operation of the water pump 36 is changed so that the amount of water flowing to the water circulation unit is more reduced than when the first refrigerant circulation unit is operated in the heating mode (S84). In this case, the amount of water flowing to the cooling and heating pipe 63 of the cooling and heating unit 5 is reduced, thereby making it possible to minimize the reduction of the indoor temperature.

Next, while the first refrigerant circulation unit is operated in the defrosting mode, it is determined whether the defrosting is ended (S85). When the defrosting is ended, the water pump 36 is operated in the previous state, such that the flowing amount of the cooling and heating pipe 63 is returned to the previous state (S86). The first refrigerant circulation unit is operated in the previous mode (S87).

What is claimed is:

1. A water circulation system associated with a refrigerant cycle comprising:

a first refrigerant circulation unit where a first refrigerant exchanging heat with outdoor air flows to perform the refrigerant cycle;

a second refrigerant circulation unit where a second refrigerant exchanging heat with the first refrigerant flows to perform the refrigerant cycle;

a water circulation unit where water for at least one of indoor heating/cooling and hot water supplying flows;

a first water refrigerant heat exchanger that performs the heat exchange between the first refrigerant and water;

a second water refrigerant heat exchanger that performs the heat exchange between the second refrigerant and water;

a first flow control unit that selectively prevents the flow of water to the first water refrigerant heat exchanger; and a second flow control unit that selectively prevents the flow of water to the second water refrigerant heat exchanger.

2. The water circulation system associated with the refrigerant cycle according to claim 1, wherein the opening degrees of the first flow control unit and the second flow control unit are controlled according to operation conditions.

3. The water circulation system associated with the refrigerant cycle according to claim 2, wherein the operation condition includes:

a one-stage compression condition where an outdoor temperature is a first reference temperature or more and a target temperature is below a second reference temperature; and a two-stage compression condition corresponding to at least one of the case where the outdoor temperature is below the first reference temperature and the case where the target temperature is the second reference temperature or more.

4. The water circulation system associated with the refrigerant cycle according to claim 3, wherein when the one-stage compression condition is satisfied, the first flow control unit is opened and the second flow control unit is closed.

5. The water circulation system associated with the refrigerant cycle according to claim 3, wherein when satisfying the two-stage compression condition, the first flow control unit is closed and the second flow control unit is opened.

6. The water circulation system associated with the refrigerant cycle according to claim 3, wherein when satisfying the two-stage compression condition, both the first flow control unit and the second flow control unit are opened, and when satisfying the two-stage compression condition even after the reference time elapses from the time when both the first flow control unit and the second flow control unit are opened, the first flow control unit is closed.

7. The water circulation system associated with the refrigerant cycle according to claim 2, wherein the operation condition includes a mixed condition corresponding to only any one of the case where the outdoor temperature is below the first reference temperature and the case where the target temperature is the second reference temperature or more.

8. The water circulation system associated with the refrigerant cycle according to claim 7, wherein when satisfying the mixed condition, both the first flow control unit and the second flow control unit are opened.

9. The water circulation system associated with the refrigerant cycle according to claim 7, wherein when satisfying the mixed condition, the flow amount of water to the first water refrigerant heat exchanger and the second water refrigerant heat exchanger is varied to be in inverse proportion to each other by the first flow control unit and the second flow control unit.

10. The water circulation system associated with the refrigerant cycle according to claim 7, wherein the opening degrees of the first flow control unit and the second flow control unit are controlled so that the ratio of the opening degrees of the first flow control unit and the second flow control unit is proportional to the difference between the outdoor temperature and the first reference temperature when satisfying the mixed condition.

11. The water circulation system associated with the refrigerant cycle according to claim 1, wherein the second refrigerant circulation unit includes a second compressor that compresses the second refrigerant, and when the operation of the second compressor stops, the flow of the second refrigerant to the second water refrigerant heat exchanger is prevented by the second flow control unit.

12. The water circulation system associated with the refrigerant cycle according to claim 1, further comprising:

an outdoor temperature sensor that senses the temperature of the outdoor air;

a target temperature sensor that senses the temperature of the target controlled for at least one of the indoor cooling and heating and hot water supplying; and a compressor operation sensor that senses whether the compressor is operated.

13. The water circulation system associated with the refrigerant cycle according to claim 1, wherein the first water refrigerant heat exchanger includes three flow passages that independently flows the first refrigerant, the second refrigerant, and water so that the first refrigerant, the second refrigerant, and water are heat-exchanged independently.

14. The water circulation system associated with the refrigerant cycle according to claim 13, further comprising:

an outdoor heat exchanger that performs the heat exchange between the outdoor air and the first refrigerant;

a main pipe that connects to the water circulation unit to the second water refrigerant heat exchanger; and a branch pipe that connects the water circulation unit to the first water refrigerant heat exchanger, wherein when the defrosting operation condition for defrosting the outdoor heat exchanger is satisfied during the healing operation, the refrigerant flow direction of the first refrigerant circulation unit is switched and the flow of water through the branch pipe is prevented.

15. The water circulation system associated with the refrigerant cycle according to claim 13, further comprising:

an outdoor heat exchanger that performs the heat exchange between the outdoor air and the first refrigerant;

a water pipe that guides water flowing the water circulation unit, wherein when the defrosting operation condition for defrosting the outdoor heat exchanger is satisfied during the heating operation, the refrigerant flow direction of the first refrigerant circulation unit is switched and the flow of water through the water pipe is prevented.

16. A water circulation system associated with a refrigerant cycle comprising:

a first refrigerant circulation unit where a first refrigerant exchanging heat with outdoor air flows to perform the refrigerant cycle;

a second refrigerant circulation unit where a second refrigerant exchanging heat with the first refrigerant flows to perform the refrigerant cycle;

a water circulation unit where water for at least one of indoor heating/cooling and hot water supplying flows;

a first water refrigerant heat exchanger that performs the heat exchange between the first refrigerant and water: and a second water refrigerant heat exchanger that performs the heat exchange between the second refrigerant and water;

wherein at least one of the flow of water to the first water refrigerant heat exchanger and the flow of water to the second water refrigerant heat exchanger is selectively prevented according to operation conditions.

17. The water circulation system associated with the refrigerant cycle according to claim 16, wherein the operation condition includes:

a one-stage compression condition where an outdoor temperature is a first reference temperature or more and a target temperature is below a second reference temperature; and a two-stage compression condition corresponding to at least one of the case where the outdoor temperature is below a first reference temperature and the case where the target temperature is a second reference temperature or more; and a mixed condition corresponding to only any one of the case where the outdoor temperature is below the first reference temperature and the case where the target temperature is the second reference temperature or more.

18. The water circulation system associated with the refrigerant cycle according to claim 17, wherein when satisfying the one-stage compression condition, water flows through the first water refrigerant heat exchanger and the flow of water to the second water refrigerant heat exchanger is prevented.

19. The water circulation system associated with the refrigerant cycle according to claim 17, wherein when satisfying the two-stage compression condition, the flow of water to the first water refrigerant heat exchanger is prevented and water flows through the second water refrigerant heat exchanger.

20. The water circulation system associated with the refrigerant cycle according to claim 17, wherein when satisfying the mixed condition, water simultaneously flows to the first water refrigerant heat exchanger and the second water refrigerant heat exchanger.

* * * * *